US007252376B2

(12) United States Patent
Hatasa et al.

(10) Patent No.: US 7,252,376 B2
(45) Date of Patent: Aug. 7, 2007

(54) RECORDING LIQUID CONTAINER, INK JET RECORDING APPARATUS, AND CARTRIDGE COLLECTING APPARATUS

(75) Inventors: Nobuyuki Hatasa, Kanagawa (JP); Hajime Yamamoto, Tokyo (JP); Eiichiro Shimizu, Hong Kong (CN)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 11/147,165

(22) Filed: Jun. 8, 2005

(65) Prior Publication Data

US 2005/0231547 A1 Oct. 20, 2005

Related U.S. Application Data

(60) Division of application No. 10/410,285, filed on Apr. 10, 2003, now Pat. No. 7,128,380, which is a continuation-in-part of application No. 10/407,266, filed on Apr. 7, 2003, now abandoned.

(30) Foreign Application Priority Data

Apr. 10, 2002 (JP) ..... 2002-107763

(51) Int. Cl.
*B41J 2/175* (2006.01)

(52) U.S. Cl. ..... 347/86; 347/84; 347/85

(58) Field of Classification Search ..... 347/14, 347/19, 85, 86, 87, 84, 7, 5
See application file for complete search history.

(56) References Cited

U.S. PATENT DOCUMENTS

| | | | | |
|---|---|---|---|---|
| 5,351,728 | A | 10/1994 | Ban et al. | 141/364 |
| 5,649,270 | A | 7/1997 | Omata et al. | 399/262 |
| 5,923,917 | A | 7/1999 | Sakurai et al. | 399/27 |
| 5,956,541 | A | 9/1999 | Hoshika et al. | 399/24 |
| 6,227,643 | B1 | 5/2001 | Purcell et al. | 347/19 |
| 6,404,995 | B1 | 6/2002 | Kimizuka | 399/13 |
| 6,442,403 | B1 | 8/2002 | Becot et al. | 455/575.1 |
| 6,502,917 | B1 | 1/2003 | Shinada et al. | 347/19 |
| 6,515,692 | B2 | 2/2003 | Koga et al. | 347/117 |
| 6,742,857 | B2 | 6/2004 | Koshikawa et al. | 347/19 |
| 6,935,716 | B2 * | 8/2005 | Hatasa et al. | 347/19 |
| 7,128,380 | B2 * | 10/2006 | Hatasa et al. | 347/7 |
| 2002/0021909 | A1 | 2/2002 | Harumoto | 399/27 |
| 2002/0030714 | A1 | 3/2002 | Walker | 347/19 |
| 2002/0031357 | A1 | 3/2002 | Watanabe et al. | 399/12 |
| 2002/0063760 | A1 | 5/2002 | Dietl et al. | 347/86 |

(Continued)

FOREIGN PATENT DOCUMENTS

| | | |
|---|---|---|
| DE | 199 17 229 | 10/2000 |

(Continued)

*Primary Examiner*—Lam Son Nguyen
(74) *Attorney, Agent, or Firm*—Fitzpatrick, Cella, Harper & Scinto

(57) ABSTRACT

A recording liquid container for containing liquid for recording to be supplied to recording means, said recording liquid container being detachably mountable to a mounting portion of a recording device, said recording liquid container includes an Information memory medium storing predetermined information; a wireless sending element capable of wireless sending of a predetermined information in said information memory medium within a predetermined range; a wireless communication antenna for wirelessly sending radio wave; and communication property changing element for changing a communication property of the wireless sending.

12 Claims, 16 Drawing Sheets

U.S. PATENT DOCUMENTS

| | | | | |
|---|---|---|---|---|
| 2002/0109761 | A1 | 8/2002 | Shimizu et al. | 347/86 |
| 2002/0135630 | A1 | 9/2002 | Kosugi | 347/19 |
| 2002/0154181 | A1 | 10/2002 | Kubota et al. | 347/7 |
| 2003/0103774 | A1 | 6/2003 | Watanabe et al. | 399/12 |
| 2003/0214546 | A1 | 11/2003 | Hatasa et al. | 347/19 |
| 2003/0227501 | A1 | 12/2003 | Hatasa et al. | 347/19 |

FOREIGN PATENT DOCUMENTS

| | | |
|---|---|---|
| DE | 199 54 749 | 5/2001 |
| EP | 1055979 | 11/2000 |
| EP | 1060895 | 12/2000 |
| EP | 1088668 | 4/2001 |
| JP | 11-316534 | 11/1996 |
| JP | 2000-37880 | 2/2000 |
| JP | 2000-330434 | 11/2000 |
| JP | 2001-117309 | 4/2001 |
| JP | 2001-331069 | 11/2001 |
| JP | 2001-358291 | 12/2001 |
| JP | 2002-19147 | 1/2002 |
| JP | 2002-62784 | 2/2002 |
| JP | 2002-72784 | 3/2002 |
| JP | 2002-172812 | 6/2002 |
| WO | 02/02337 | 1/2002 |

* cited by examiner

RECORDING LIQUID CONTAINER, INK JET RECORDING APPARATUS, AND CARTRIDGE COLLECTING APPARATUS

This application is a division of U.S. application Ser. No. 10/410,285, filed Apr. 10, 2003, issued as U.S. Pat. No. 7,128,380, which was a continuation-in-part of application Ser. No. 10/407,266, filed Apr. 7, 2003, now abandoned, the contents of which are incorporated herein by reference.

FIELD OF THE INVENTION AND RELATED ART

The present invention relates to a recording liquid container for storing the recording liquid to be supplied to a recording head, an ink jet recording apparatus in which a recording container in the form of a cartridge or the like is removably mountable, and a cartridge collecting apparatus for collecting a recording liquid container.

There have been available various apparatuses, a part of which is in the form of a cartridge removably mountable in the main assembly of the apparatus. For example, some ink jet printers comprise the main assembly, and a single or plurality of ink cartridges removably mountable in the main assembly.

One of such printing apparatuses is disclosed in Japanese Laid-open Patent Application 2000-037880, according to which an ink cartridge is provided with an information storage medium, making it possible to transfer information from an ink cartridge to the main assembly of the printing apparatus. This patent application also discloses the technology for carrying out the information transfer in the non-contact manner with the use of radio waves.

However, the technology disclosed in the aforementioned patent application is based on the assumption that the communication between an ink cartridge and the main assembly of a printer occurs only when an ink cartridge is in the proper position in the main assembly, being on standby for a printing operation or being actually used for a printing operation. Therefore, it is difficult to communicate with an ink container, with the use of this technology, prior to the proper mounting of the ink container in the apparatus main assembly, for example, during the shipment of the ink container. That is, during the shipment of the ink container, the ink cartridge is inside the wrapping. Therefore, the communication with the ink cartridge must be carried out from outside the wrapping. In other words, it must be carried out wirelessly. In order to wirelessly communicate with the ink container within the wrapping, the communication range of the ink cartridge must be long enough to reach beyond the wrapping.

However, there is a possibility that the extension of the communication range of an ink cartridge will derogatorily affect the circuitry in the printer main assembly, when the ink cartridge is in the printer main assembly. There is another possibility related to a full-color ink jet printer. That is, a full-color ink jet printer employs a plurality of ink cartridges, which are disposed close to each other. Thus, if the communication range of each ink cartridge is greater than a certain value, the radio waves from the plurality of ink cartridges will interfere with each other.

SUMMARY OF THE INVENTION

The present invention was made in consideration of the above described problems, and its primary object is to provide an ink cartridge capable of properly communicating while it is in the main assembly of a printer, being on standby, or actually used, for a printing operation, as well as while it is outside the apparatus main assembly, for example, during its shipment.

According to an aspect of the present invention, there is provided a recording liquid container for containing liquid for recording to be supplied to recording means, said recording liquid container being detachably mountable to a mounting portion of a recording device, said recording liquid container comprising an information memory medium storing predetermined information; wireless sending means capable of wireless sending of a predetermined information in said information memory medium within a predetermined range; a wireless communication antenna for wirelessly sending radio wave; and communication property changing means for changing a communication property of the wireless sending.

According to another aspect of the present invention, there is provided a printer to which an ink cartridge is detachably mountable, said apparatus includes a cartridge mounting means for mounting the ink cartridge, said ink cartridge including an information memory medium storing predetermined information; wireless sending means capable of wireless sending of a predetermined information in said information memory medium within a predetermined range; a wireless communication antenna for wirelessly sending radio wave; and communication property changing means for changing a communication property of the wireless sending; said apparatus further includes wireless communicating means for wireless communication with said antenna, said wireless communicating means being disposed within a sendable range for in-use state of said ink cartridge.

Accordint to a further aspect of the present invention, there is provided a cartridge collecting apparatus for collecting an ink cartridge, includes collecting means for receiving an ink cartridge including an information memory medium storing predetermined information; wireless sending means capable of wireless sending of a predetermined information in said information memory medium within a predetermined range; a wireless communication antenna for wirelessly sending radio wave; and communication property changing means for changing a communication property of the wireless sending; and wireless communicating means for wireless communication with the antenna, said wireless communicating means being disposed within a sendable range of the wireless sending when the ink cartridge is disposable.

According to a further aspect of the present invention, there is provided a cartridge detachably mountable to a main assembly, said cartridge including a main body; an information memory medium storing predetermined information; a wireless communication antenna for wirelessly sending radio wave; wireless communication means for wireless communication using the antenna; and communication property changing means for changing a communication property of the wireless sending.

With such cartridge, the predetermined information stored in the memory medium is wirelessly sent by the wireless communication anttena. Since the cartrige is provided with the communication property changing means, the optimum communication properties can be provided depending on the situations including the transportation stage before it is mounted to the main assembly, the mounted stage wherein the cartridge is mounted to the main assembly, the disposable stage in which the cartridge is removed fromm the main assembly and the like.

The communication properties include the communicatable range, the communicating direction and the combination of them. The communicatable range can be changed by changing the length of antenna.

According to a further aspect of the present invention, there is provided an ink cartridge detachably mountable to a main assembly, said ink cartridge including a main body for containing the ink to be supplied to the main assembly of the printer; an information memory medium storing predetermined information; a wireless communication antenna for wirelessly sending radio wave; wireless communication means for wireless communication using the antenna; and communication property changing means for changing a communication property of the wireless sending.

According to a further aspect of the present invention, there is provided a container which is accommodated in a package having a portion through which the wireless communication is capable, during transportation.

According to a further aspect of the present invention, there is provided a container which is accommodated in a package having a portion through which the wireless communication is capable in a plurality of directions, during transportation.

According to a further aspect of the present invention, there is provided a main assembly of a printer comprising a cartridge mounting means for mounting the ink cartridge, wireless communicating means for wireless communication with said antenna, said wireless communicating means being disposed within a sendable range for in-use state of said ink cartridge.

According to a further aspect of the present invention, there is provided a main assembly of a printer comprising a cartridge mounting means for mounting the ink cartridge, electric power supplying means for supplying electric power, wireless communicating means for wireless communication with said antenna, said wireless communicating means being disposed within a sendable range for in-use state of said ink cartridge.

According to a further aspect of the present invention, there is provided a printer comprising the main assembly and the ink cartridge.

According to a further aspect of the present invention, there is provided a cartridge collecting apparatus for collecting ink cartridges, including wireless communicating means for wireless communication with the antenna, said wireless communicating means being disposed within a sendable range of the wireless sending when the ink cartridge is disposable.

Regarding the various means mentioned in the above description of the present invention, all that is required of them is to be able to function as described above. Thus, they may be in the form of, for example, a dedicated hardware capable of performing predetermined functions, a computer programmed to perform predetermined functions, predetermined functions realized in a computer with the use of programs, or the combinations thereof, etc.

Further, it is not mandatory that they are independent from each other. For example, two or more of the above described various means may be integrated into a single component. One means may be formed as a part of another means. A part of one means may constitute a part of another means. In other words, they may be configured in an optimum fashion.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 1:
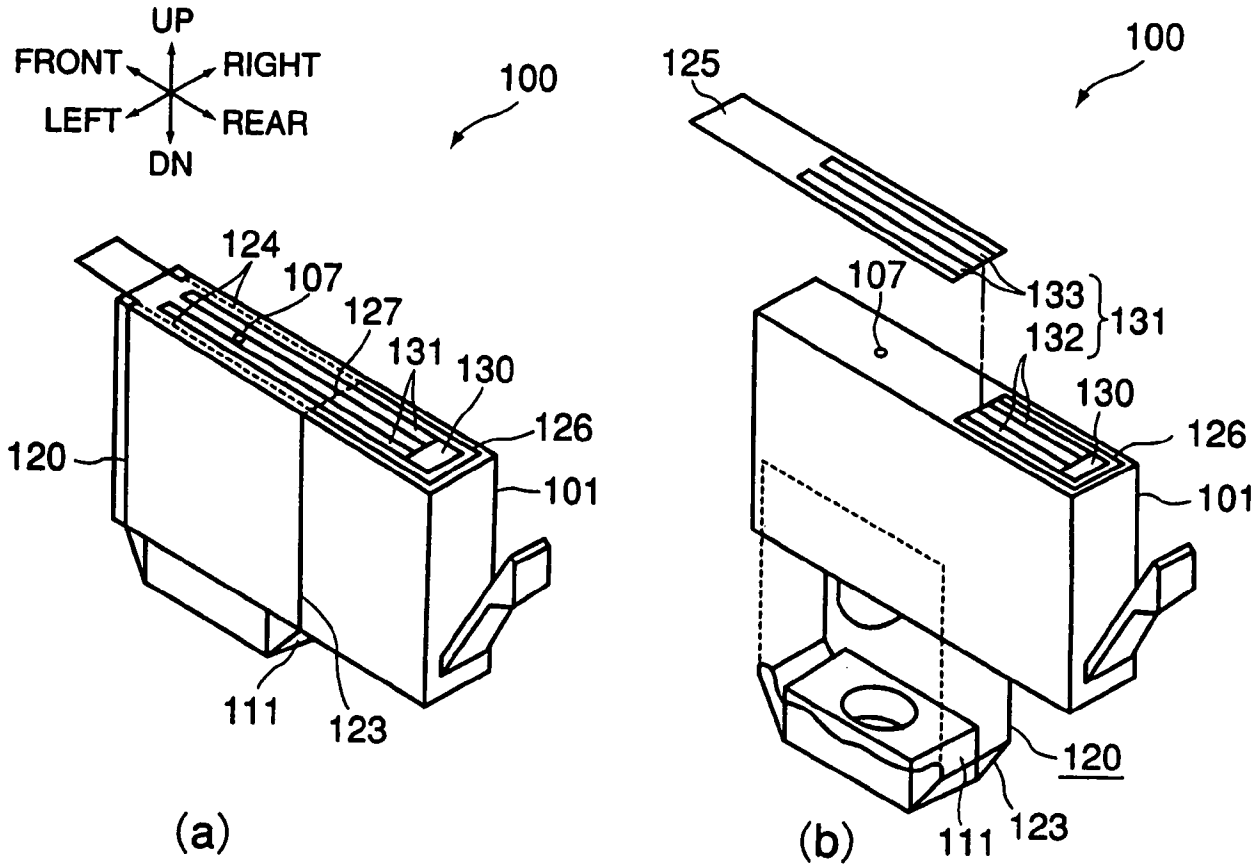
FIGS. 1(*a*)-1(*b*) is a perspective view of the first embodiment of an ink cartridge in accordance with the present invention, showing the state of the ink cartridge during its shipment, and the state of the ink cartridge during its actual usage.

Referring to FIGS. 1-9, the first embodiment of the present invention will be described. Incidentally, hereinafter, the preferred embodiments of the present invention will be described with reference to the front, rear, right, and left directions indicated by arrow marks in the drawings. The usage of this directional reference is for the simplification of the description, and has nothing to do with the positioning of the ink cartridge during the production, usage, etc., of the apparatuses in accordance with the present invention.

[Structure]

Figure 2:
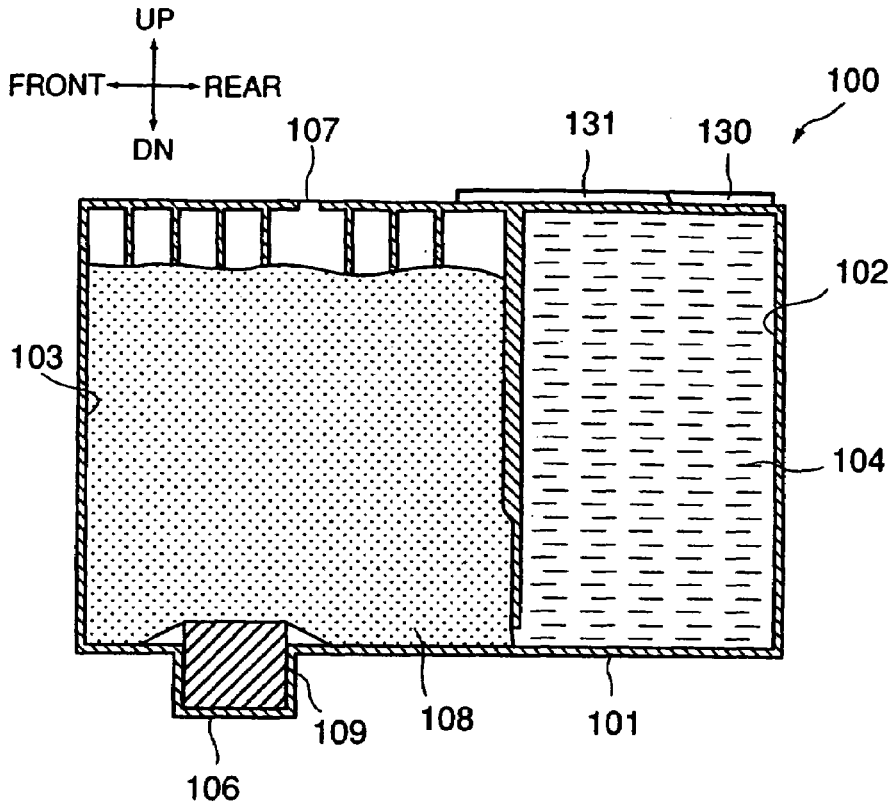
FIG. 2 is a vertical sectional view of the ink cartridge, at a plane parallel to one of its side walls, showing the internal structure thereof.
Figure 8:
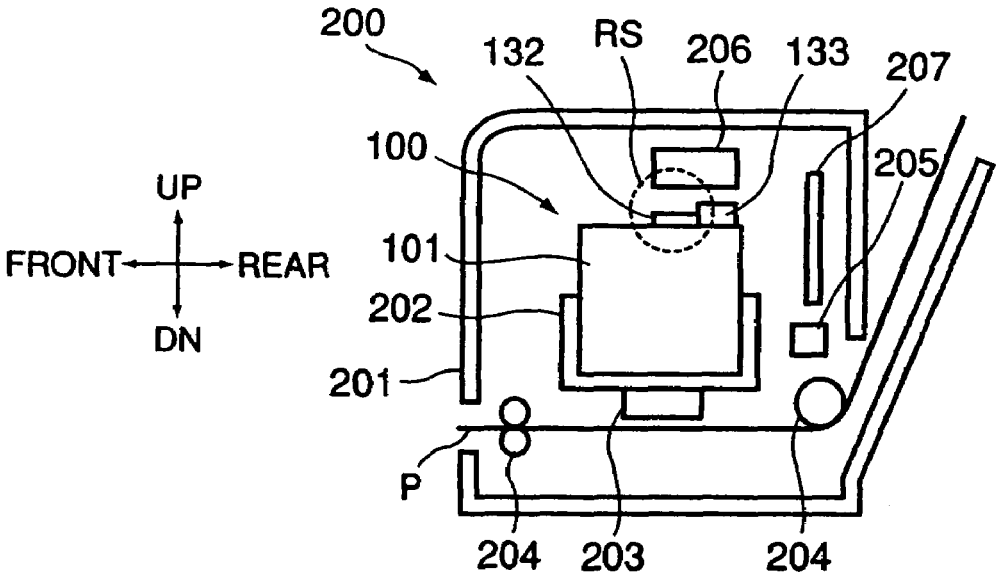
FIG. 8 is a vertical sectional view of a typical ink jet printing apparatus, at a plane parallel to one of its side walls, showing the internal structure thereof.

Referring to FIGS. 1 and 2, the cartridge 100 in this embodiment of the present invention is an ink cartridge having a main assembly. It is removably mountable in the main assembly 201 of a printing apparatus 200 as an example of an apparatus which employs a cartridge system, as shown in FIG. 8.

Referring to FIG. 1, the main assembly 101 of this ink cartridge 100 is in the form of a flat box, and is molded of a resinous substance. Referring to FIG. 2, the internal space of the main assembly 101 comprises an ink storage chamber 102, and a negative pressure generation chamber 103, which are separated by a partition. The ink storage chamber 102 is in connection with the negative pressure generation chamber 103, at their bottom ends, and contains ink 104 in the liquid form.

The negative pressure generation chamber 103 has an ink outlet 106 and an air vent 107. The ink outlet 103 is attached to the bottom portion of the negative pressure generation chamber 103, whereas the air vent 107 is in the top wall of the negative pressure generation chamber 103. Further, the negative pressure generation chamber 103 is filled with a porous member 108, and the ink outlet 106 is filled with a porous member 109. In the case of this cartridge main assembly 101, the ink in the ink storage chamber 102 is supplied to the printer main assembly 201 through the ink outlet 106 after going through the negative pressure generation chamber 103.

Referring to FIG. 1(*a*), prior to the proper mounting of this ink cartridge 100 in accordance with the present invention into the printer main assembly 201, for example, during the shipment of the ink cartridge 100, the ink outlet 106 of the cartridge main assembly 101 is kept hermetically sealed with an ink cap 111 as a protective member, which remains covered with a label 120 until the label is removed from the ink cartridge 100. The label 120 is wrapped around the cartridge main structure 101, and functions as a protective member as well as a wireless communication unit.

Figure 3:
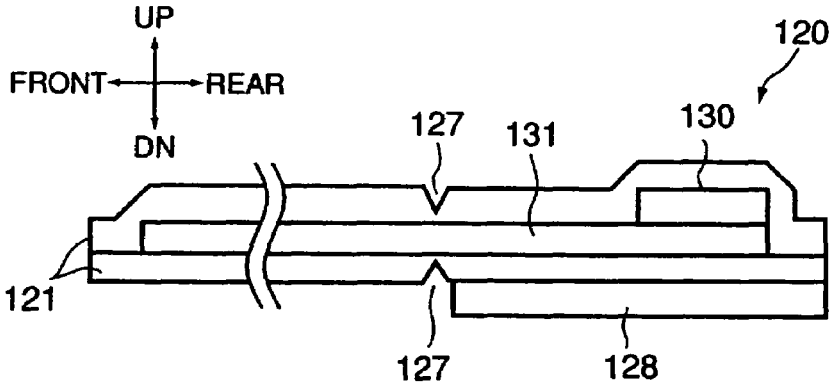
FIG. 3 is a vertical sectional view of the essential portion of the label, as both the protective layer and radio unit, at a plane parallel to one of its side walls, showing the internal structure thereof.
Figure 4:
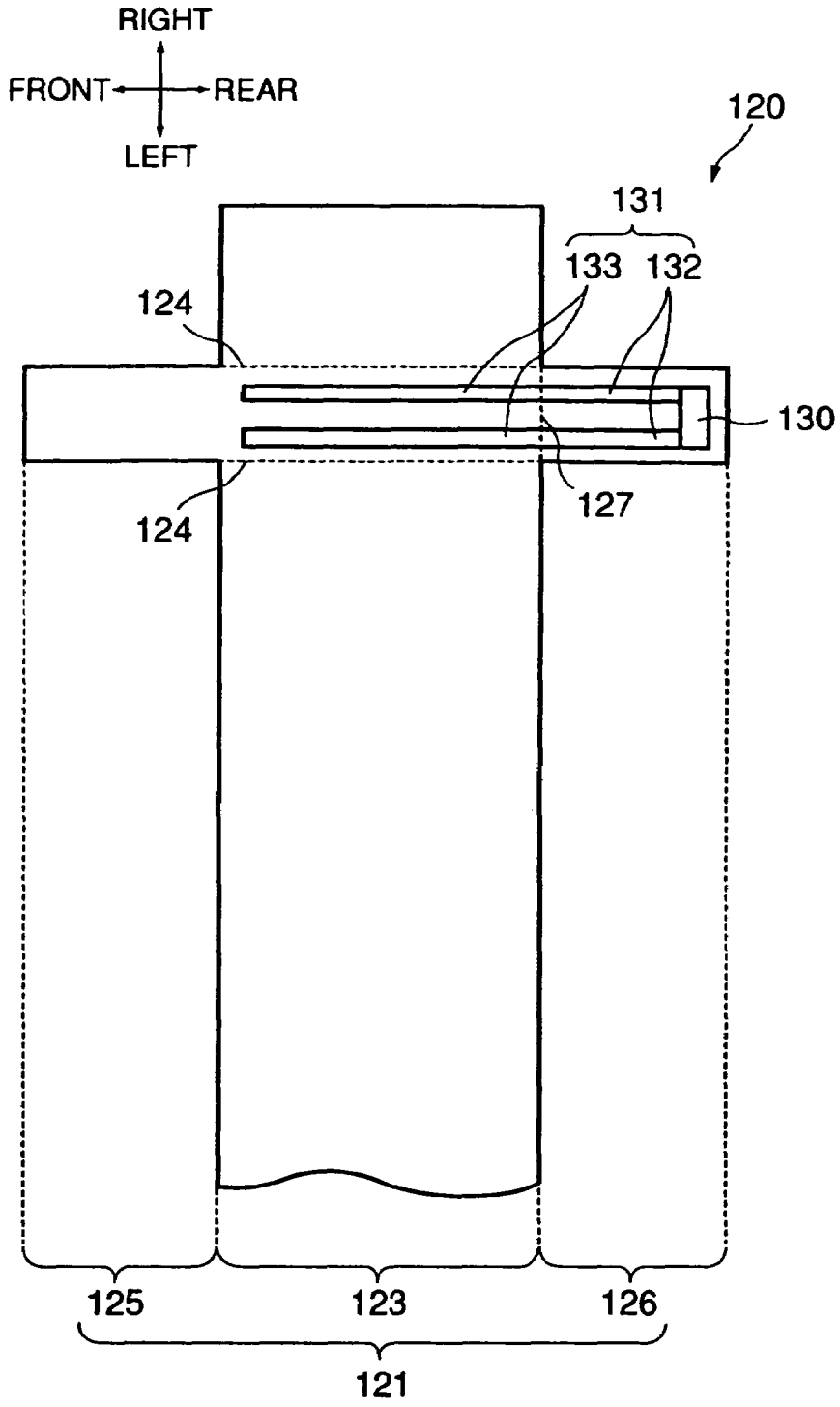
FIG. 4 is a development of the label, showing the external appearance thereof.

Referring to FIG. 3, this label 120 is formed of transparent and thermally shrinkable sheet 121. Referring to FIG. 4 which is a development of the label 120, it has a belt-like portion 123, which extends in the left-right direction. Referring to FIG. 1(*a*), this belt-like portion, actually, constitutes an endless belt, and is fitted around the cartridge main assembly 101, covering the ink cap 111 as well as hermetically sealing the air vent 107 of the cartridge main assembly.

Next, referring to FIG. 1(*a*) and FIG. 4, this belt-like portion 123 of the label 120 has a pair of perforated lines 124, which are positioned so that as the label 120 is properly fitted around the cartridge main assembly 101, the lines will extend along the left and right edges of the top surface of the cartridge main assembly 101. The label 120 also has rectangular tabs 125 and 126, which extend from the front and rear sides, respectively, of the portion of the belt 120 between the pair of perforated lines 124, perpendicular to the belt-like portion 123. The border between the rectangular tab 126 and the belt-like portion 123 is perforated (perforated line 127).

Referring to FIG. 3, the label 120 is coated with adhesive 128 only across the back surface of the rectangular tab 126. Thus, as the tab 125 of the label 120 around the cartridge main assembly 101 is pulled upward, the label 120 is torn along the pair of perforated lines 124 and the perforated line 127. As a result, only the rectangular tab 126 remains on the cartridge main assembly 101, as shown in FIG. 1.

Next, referring to FIGS. 1 and 4, this ink cartridge 100 in accordance with the present invention is provided with a circuitry chip 130 in the form of a piece of paper, which is embedded in the rear end portion of the rectangular tab 126 of the label 120. The circuitry chip 130 is connected to a pair of radio antennas 131 in the form of a long and narrow piece of paper, which extends from the circuitry chip 130 to the adjacencies of the tab 125.

Each radio antenna 131 comprises a first portion 132 and a second portion 133. The first portion 132 extends across the rectangular tab 126 of the label 120, whereas the second portion 133 extends across the aforementioned belt-like portion 123. Thus, as the label 120 around the cartridge main assembly 101 is torn along the perforated lines 124 and 127, leaving only the rectangular tab 126 on the cartridge main assembly 101, the pair of radio antennas 131 are reduced in length to the approximately ⅓-½ of their original lengths.

In other words, in the case of this ink cartridge 100 in accordance with the present invention, its structural arrangement that the portion of each radio antenna 131 beyond the perforated line 127, as seen from the circuitry chip 130 side, is removable, constitutes the property varying means in this application of the present invention.

Figure 5:
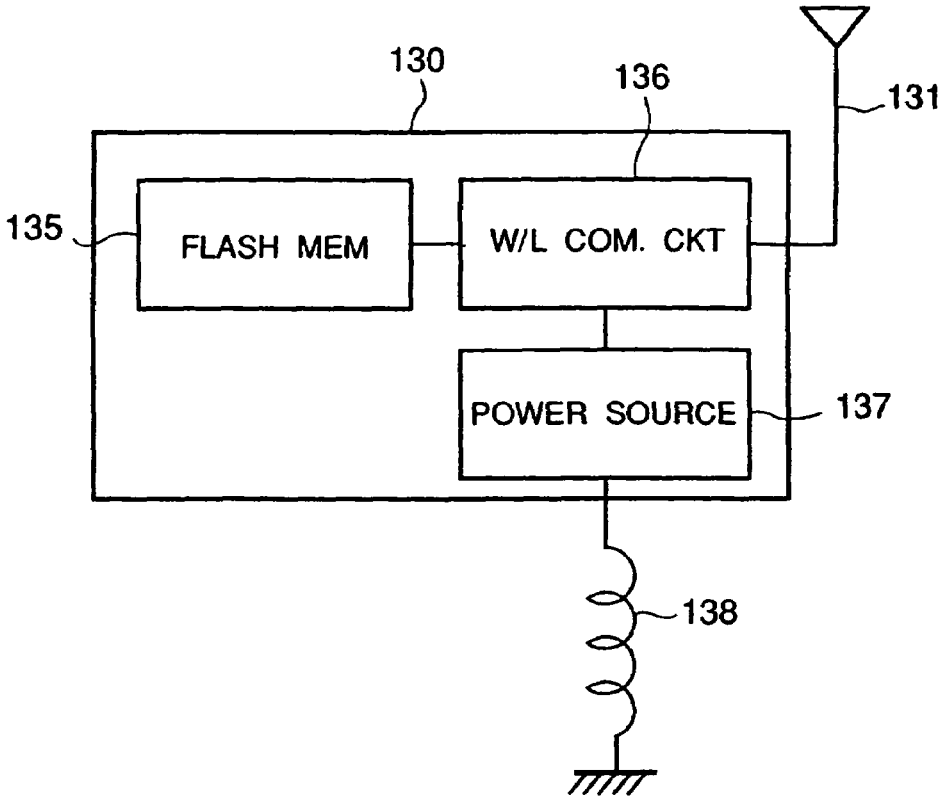
FIG. 5 is a block diagram of the label circuitry, showing the structure thereof.

Referring to FIG. 5, the circuitry chip 130 comprises: a flash memory 135 as an information storage medium; a wireless communication circuit 136 as both a wireless transmitting means and an information storing medium; and a power source circuit 137 as a part of an electric power generating means.

The flash memory 135 stores in the updatable fashion, various information (unshown), for example, data for identifying ink cartridge type, data for identifying printer main assembly type, production date, expiration date, ink remainder amount, etc.

To the power source circuit 137, an induction coil 138 as a part of the power generating means is connected. This induction coil 138 is included in the bottom layer of the circuitry chip 130. The combination of the induction coil 138 and power source circuit 137 generates electric power, based on electromagnetic induction. The generated electric power is supplied from the power source circuit 137 to the wireless communication circuit 136, which uses the electric power to transmit the predetermined type of information in the flash memory 135, in the form of radio waves, through the radio antenna 131, and also to receive radio waves through the radio antenna 131, extract predetermined types of information carried by the received radio waves, and store the information in the flash memory 135.

Figure 6:
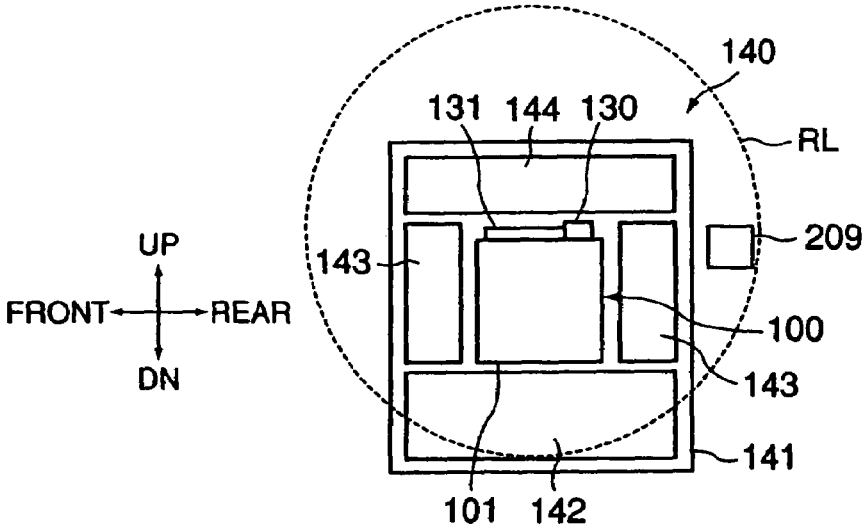
FIG. 6 is a vertical sectional view of a shipment package for an ink cartridge, at a plane parallel to one of its side walls, showing the internal structure thereof.
Figure 7:
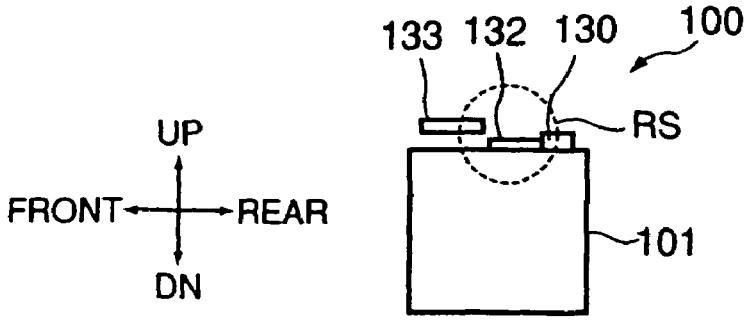
FIG. 7 is a schematic side view of the ink cartridge in use.

Referring to FIG. 6, during the shipment of this ink cartridge 100 in accordance with the present invention, that is, while it is shipped out of a factory and is conveyed to an end user, the entirety of the label 120 remains fitted around the cartridge main assembly 101. However, during its actual usage, that is, after it is mounted into the printer main assembly by the end user, only the rectangular tab 126 of the label 120 remains on the cartridge main assembly 101.

Thus, the length of each radio antenna 131 of this ink cartridge 100 in accordance with the present invention while the ink cartridge 100 is in use is ⅓-½ of the length of the radio antenna 131 during the shipment of the ink cartridge 100. Therefore, the communication range RL of the wireless communication circuit 136 during the shipment of the ink cartridge 100 is greater than the communication range RS of the wireless communication circuit 136 during the usage of the ink cartridge 100.

During the shipment, the ink outlet 106 and air vent 107 of the main assembly 101 of the ink cartridge 100 remain hermetically sealed with the ink cap 111 and label 120, respectively. Further, the entirety of the ink cartridge 100 remains wrapped in the packaging members 141-144 as the parts of an ink cartridge shipment package 140, as shown in FIG. 6.

The packaging member 141 is a box-shaped container, and the packaging members 142-144 are filling members filled in the gaps between the packaging member 141 and ink cartridge 100. These packaging members 141-144 are formed of paper, resin, etc., which easily transmits radio waves. They are structured so that after the proper packaging of the ink cartridge 100 by the packaging members 141-144, the external surface of five of the six walls of the box-shaped packaging member 141, that is, the outermost packaging member, is within the communication range RL of the ink cartridge 100.

Referring to FIG. 8, when the ink cartridge 100 is in use, that is, after the proper mounting of the ink cartridge 100 in the printer main assembly 201 by an end user, only the rectangular tab 126 of the label 120 remains on the cartridge main assembly 101, as shown in FIG. 1(*b*), because the belt-like portion 123 is removed before the mounting of the ink cartridge 100.

Figure 9:
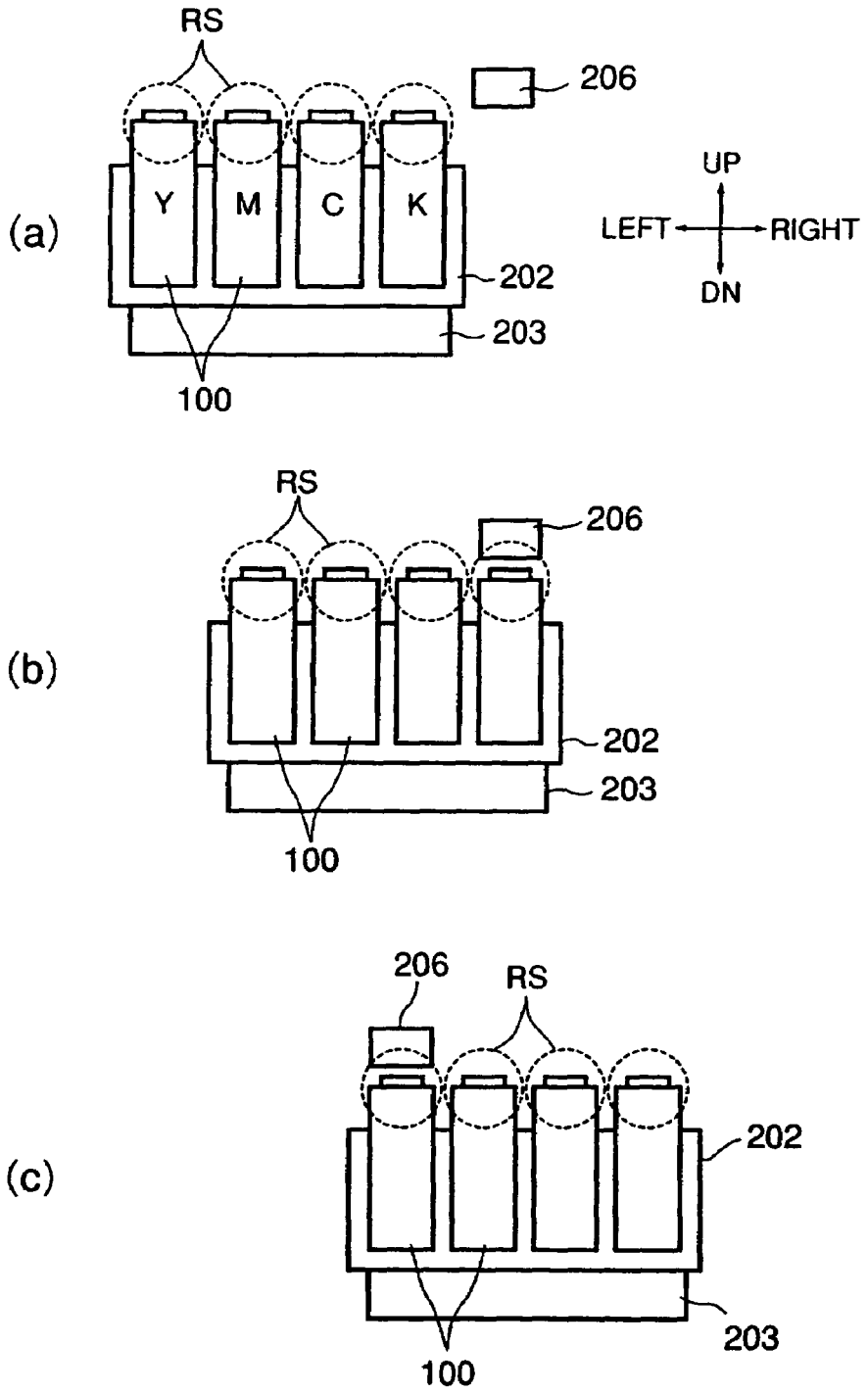
FIGS. 9(*a*)-9(*c*) is a front view of the combination of the carriage as a cartridge holding means, and a plurality of ink cartridges thereon.
Figure 10:
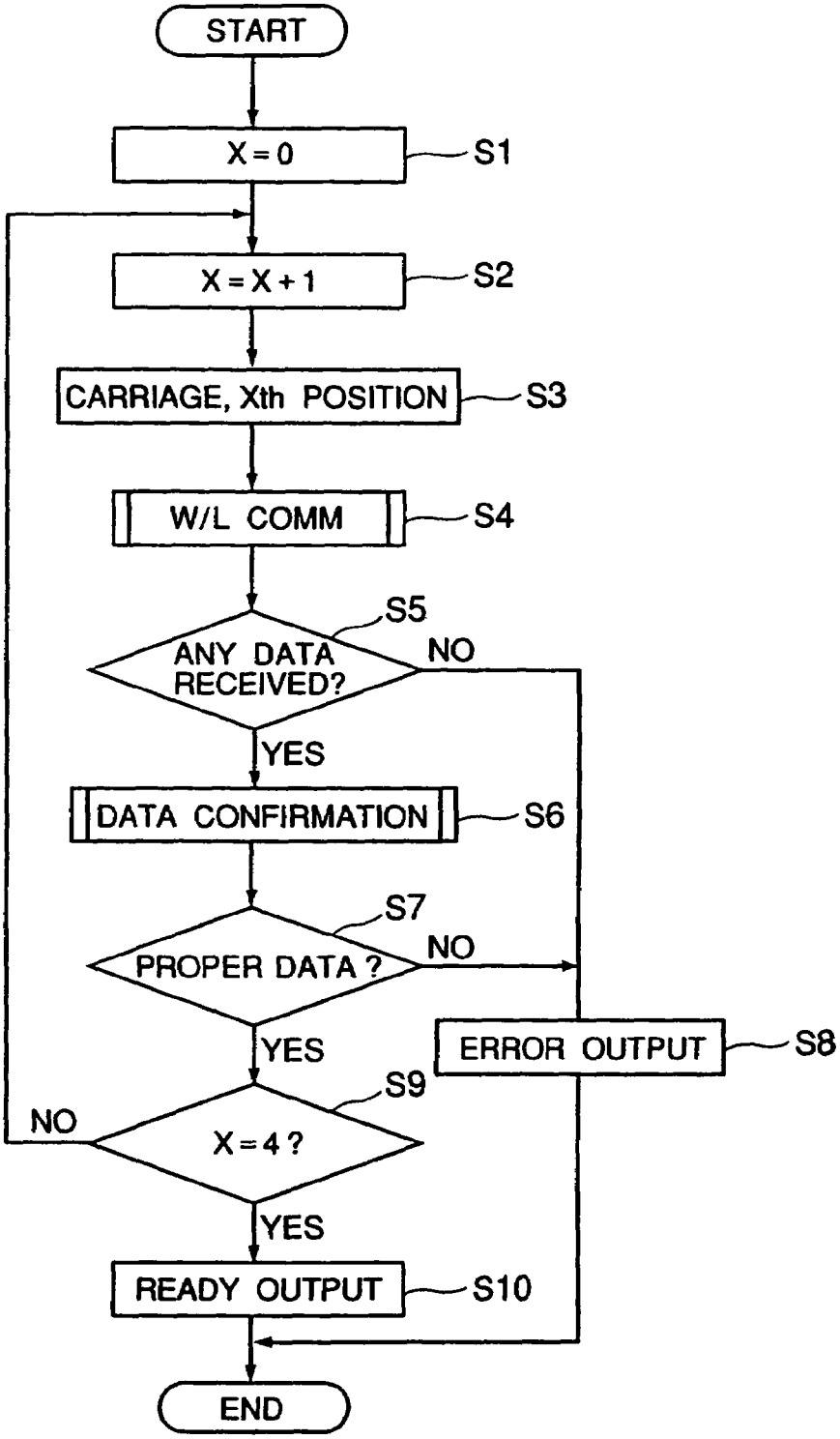
FIG. 10 is a flowchart of the initialization process for the printing apparatus.

This printing apparatus 200 in accordance with the present invention is a full-color ink jet printer, and employs one carriage 202 as a cartridge holding means, and four ink cartridges 100. The four ink cartridges 100 are different in the color of the ink therein (yellow, magenta, cyan, and black), and are arranged in the left-right direction, on the carriage 100, as shown in FIG. 9.

To the bottom surface of the carriage 202, an ink jet head 203 is attached. This combination of the carriage 202 and ink jet head 203 is supported by a primary scan mechanism (unshown) as a cartridge moving means so that the combination can be freely moved in the left-right direction. The primary scan mechanism comprises a single or plurality of guide rails, a driver motor, etc.

Referring to FIG. 8, in the bottom portion of the internal space of the printer main assembly 201, there is disposed a secondary scan mechanism (unshown) comprising a feed roller 204, a driving motor 205, etc. A sheet of printing paper P is conveyed frontward so that it opposes the ink jet head 203 from underneath.

Further, in the top portion of the internal space of the printer main assembly 210, there is disposed a single communication unit 206, as both a power supplying means and a wireless communicating means. Not only does this communication unit 206 electromagnetically induce electric current in the corresponding induction coil 138 of the ink cartridge 100, but also it wirelessly exchanges predetermined types of information with the first portion 132 of the radio antenna 131 of the ink cartridge 100. However, there a four ink cartridges 100 different in type, which are moved in the direction in which they are aligned as described above. Therefore, the single communication unit 206 wirelessly communicates with each of the four ink cartridges 100 as each ink cartridge 100 is moved into the area in which the communication unit 206 falls into communication range RS of each ink cartridge 100, as shown in FIG. 9.

Also referring to FIG. 8, in the rear portion of the internal space of the printer main assembly 210, there is disposed a circuitry substrate 207, which is connected to the primary scan mechanism, secondary scan mechanism, ink jet head 203, communication units 206, etc. The circuitry substrate 207 has a microcomputer (unshown), which integrally controls each of the above listed sections.

Next, the usage of this ink cartridge 100 in accordance with the present invention, which is structured as described above, will be concretely described. This ink cartridge 100 is manufactured by a manufacturer, distributed to an end user by a distributor, and mounted into the printer main assembly 201 of the printing apparatus 200 by the end user.

Referring to FIG. 1(*a*), in the final stage of ink cartridge manufacture, the label 120 is fitted around the cartridge main assembly 101. Then, various information (unshown), for example, data for identifying product type, production date, etc., is stored in the circuitry chip 130 while the circuitry chip 130 is supplied with electric power based on electromagnetic induction.

After the storing of the predetermined type of information in the ink cartridge 100, the ink cartridge 100 is packaged in the shipment package 140 made up of the packaging members 141-144, as shown in FIG. 6. Then, the shipment package 140 containing the ink cartridge 100 is distributed from a manufacturer to an end user by a distributor. During the distribution of the ink cartridge 100, the electromagnetic induction function, and the wireless communication function of the wireless communicating apparatus 206 as a wireless communicating means, can be used by the distributor to read from the ink cartridge 100 the predetermined type of information to be used for distribution control, and also to store, as needed, the predetermined type of information, for example, warehousing time and date, store names, etc., in the ink cartridge 100.

During the shipment of the ink cartridge 100, the label 120 remains in entirety on the ink cartridge 100, and therefore, the radio antenna 131 remains intact, offering the communication range RL, which is greater than the external measurements of the distribution package 140. Therefore, the distributor can wirelessly communicate with the ink cartridge 100 without opening the distribution package 140.

After obtaining the ink cartridge 100 rested in the distribution package 140, an end user is to remove the packaging members 141-144 by opening the distribution package 140. Then, the end user is to remove the belt-like portion 123 of the label 120 from the cartridge main assembly 101 by pulling the tab 125 upward, as shown in FIG. 1.

After the removal of the belt-like portion 123 and tab 125 of the label 120, only the rectangular tab 126 of the label 120 remains on the cartridge main assembly 101. Therefore, only the first portion 132 of the radio antenna 131 remains on the cartridge main assembly 101, reducing the communication range of the ink container 100 to the communication range RS, which is smaller than the communication range RL of the intact radio antenna 131, that is, the communication range of the ink container 100 during its shipment. Then, the ink cartridge 100 is to be mounted into the printer main assembly 201. As the ink cartridge 100 is properly mounted into the printer main assembly 201, the printing apparatus 200 becomes ready for a printing operation.

As the printing apparatus 200 connected to, for example, a host computer (unshown), is turned on, the carriage 202 is intermittently moved (Steps S1-S3) while allowing the single communication unit 206 to sequentially communicate with the four ink cartridges 100, one at a time (Step S4).

If the communication unit 206 does not receive radio waves (Step S5), the printing apparatus 200 determines that there is no ink cartridge in the corresponding location, and sends signals to the host computer, informing the host computer of the error that the ink cartridge 100 has not been mounted (Step S8).

As the communication unit 206 receives radio waves from an ink cartridge 100 (Step S5), it is confirmed, based on the data carried by the received radio waves, whether or not the ink cartridge 100 is in the specific location of the carriage 202, is proper in various aspects and properties, for example, amount of the ink remaining therein, expiration date, etc. (Step S6). If a single or plurality of improprieties are detected (Step S7), error messages corresponding to the improprieties are sent to the host computer (Step S8).

On the other hand, if the printing apparatus 200 determines that the four ink cartridges 100 all are proper, it sends a signal indicating the completion of the preparatory process to the host computer (Step S10). Recognizing this signal, the host computer sends printing data to the printing apparatus 200, and the printing apparatus 200 begins to carry out a printing operation. Incidentally, each time a printing operation is completed, the printing apparatus 200 calculates the amount of the ink 104 consumed for the operation, and updates the information regarding the remaining amount of the ink 104 in the ink cartridge 100.

[Effects]

In the case of this ink cartridge 100 in accordance with the present invention, not only is the circuitry chip 130 of the ink cartridge 100 capable of storing the predetermined type of information, but also of wirelessly communicating with the wireless communicating apparatus 206 or the printer main assembly 201 to provide them with various data or obtain various data from them.

In particular, since the ink cartridge 100 is capable of wirelessly exchange various data through radio waves, a distributor can establish data communication between the wireless communicating apparatus 209 and ink cartridge 100 without opening the distribution package 140, eliminating the fear that the data communication between the printer main assembly 201 and ink container 100 might be unsatisfactory due to the electrical contact errors between them traceable to the ink 104.

Further, the communication range RL, that is, the communication range of the ink cartridge 100 during its distribution, is greater than the external measurements of the distribution package 140, as shown in FIG. 6, and the packaging members 141-144, which make up the distribution package 140, easily transmit radio waves. Therefore, a distributor can wirelessly communicate with the ink cartridge 100, from outside the distribution package 140, with the use of the wireless communicating apparatus 206.

Moreover, the communication range RS, which is the communication range of the ink cartridge 100 in use, is smaller than the communication range RL, which is the communication range of the ink cartridge 100 during its shipment, as shown in FIGS. 8 and 9. Therefore, even if a plurality of ink cartridges 100 are disposed in the printer main assembly 201, the printer main assembly 201 is allowed to wirelessly communicate with each of the plurality of ink cartridges 100 one at a time, and the radio transmission waves from the ink cartridges 100 are prevented from affecting the microcomputer of the circuitry substrate 207 and the driving motor 205.

Further, the printer main assembly 201 is moved in the direction parallel to the direction in which the plurality of ink cartridges 100 are aligned. Therefore, the single communication unit 206 is all that is necessary to wirelessly and individually communicate with each of the plurality of ink cartridges 100. In particular, the secondary scan mechanism for moving the ink jet head 203 is used to move the plurality of ink cartridges 100 in the direction in which the ink cartridges 100 are aligned. Therefore, it is unnecessary to provide the printer main assembly 201 with a mechanism dedicated to move the ink cartridges 100.

Further, the removal of the label 120 from the cartridge main assembly 101 by an end user results in the reduction of the length of the radio antenna 131, eliminating the need for an operation dedicated to the changing of the communication range of the ink cartridge 100. Further, the circuitry chip 130 and radio antenna 131 are formed as integral parts of the label 120, eliminating the need for altering the design of the cartridge main assembly 101.

[Modifications]

The application of the present invention is not limited to the above described embodiment. In other words, the present invention can be variously modified within the scope of its essence. The above described first embodiment, for example, represents just one of the ink cartridges in accordance with the present invention. That is, as the belt-like portion 123 of the label 120 is removed from the main assembly 101 of the ink cartridge 100, the first portion 132 of the radio antenna 131 is removed with the belt-like portion 123, from the cartridge main assembly 101, becoming separated from the second portion 133 of the radio antenna 131 remaining on the cartridge main assembly 101.

Figure 11:
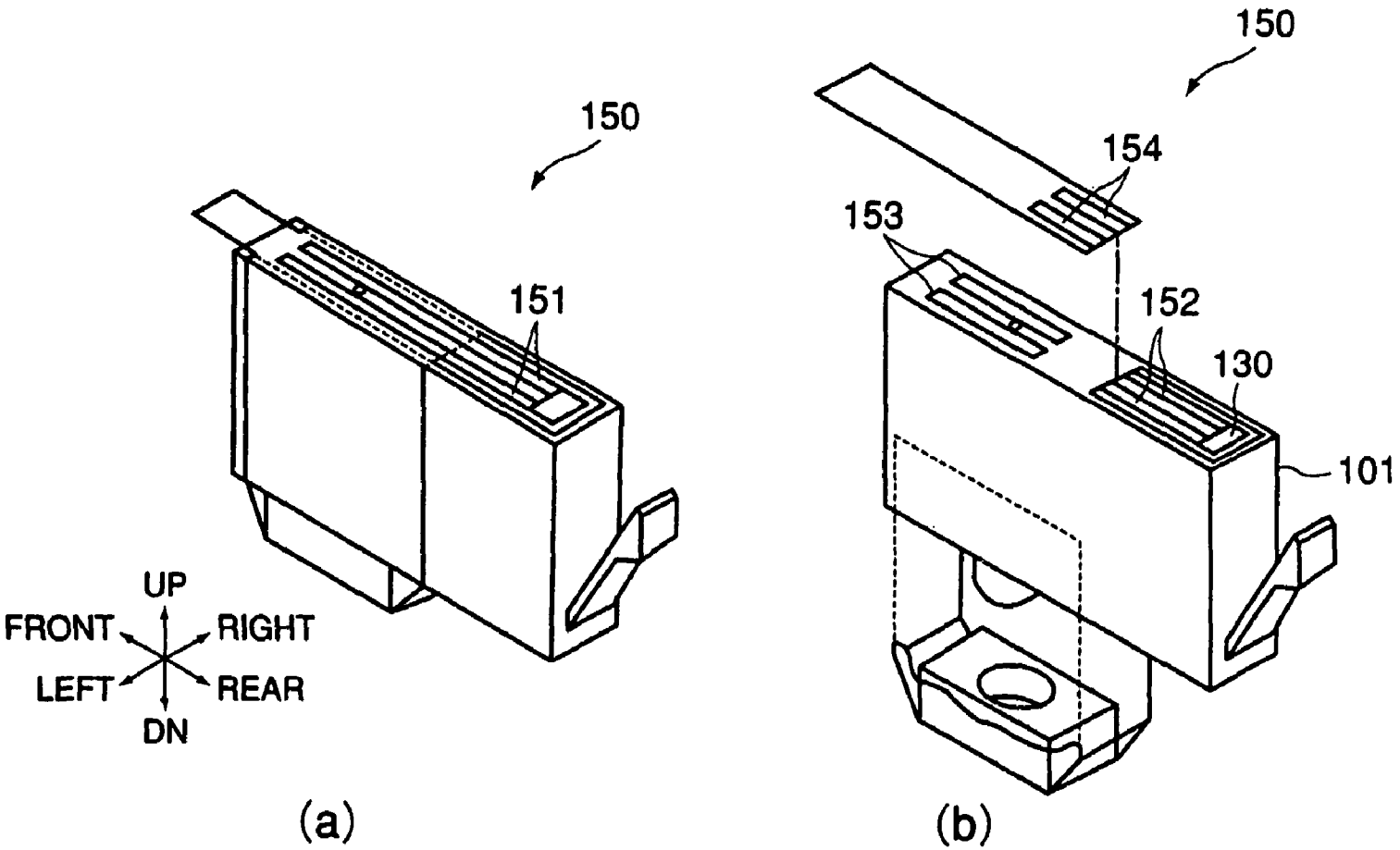
FIGS. 11(*a*)-11(*b*) is a perspective view of an ink cartridge as a part of the first embodiment the present invention.

The above described first embodiment of the present invention may be modified as demonstrated by the ink cartridge 150, shown in FIG. 11, the radio antenna 151 of which comprises three portions: first and third portions 152 and 153, which will remain on the cartridge main assembly 101, and a second portions 154, which will be removed from the cartridge main assembly 101. In this case, after the removal of the second portions 154, the remaining third portions 153 do not function, and only the first portions 152 function.

Figure 12:
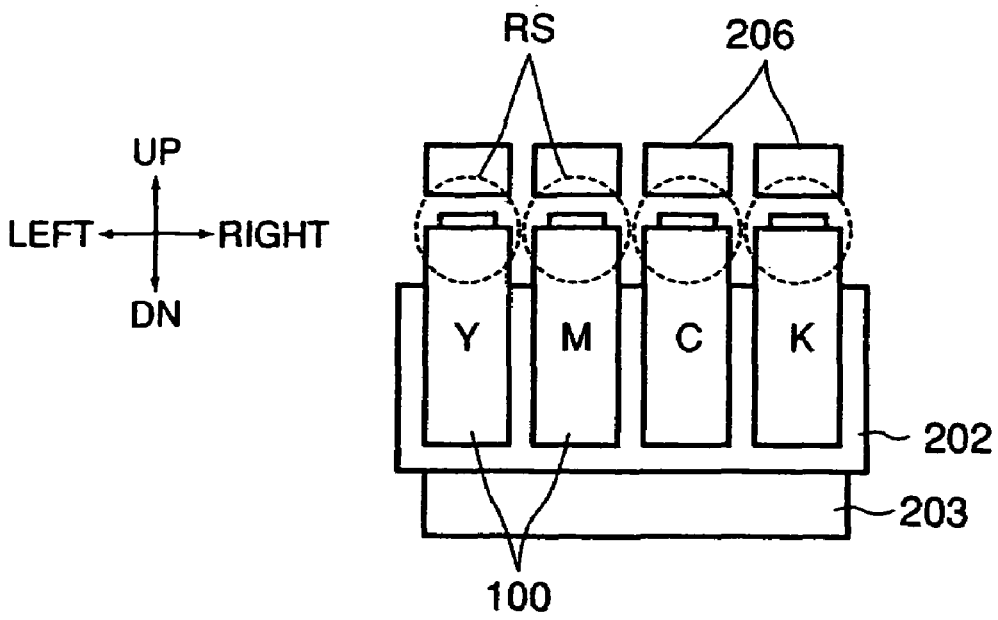
FIG. 12 is a front view of the combination of the carriage and a plurality of ink cartridges thereon, in the printing apparatus, in the second modified version of the first embodiment of the present invention.

Further, the first embodiment demonstrates the structural arrangement that the single communication unit 206 is enabled to wirelessly communicate with each of the plurality of ink cartridges 100 one at a time. However, the first embodiment may be modified, as shown in FIG. 12, so that a plurality of communication units 206 wirelessly communicate with the same number of ink cartridges 100, one for one.

In this case, it is desired that the plurality of communication units 206 are mounted on the same carriage, that is, the carriage 202. With such an arrangement, the positional relationship between a given ink cartridge 100 and the corresponding communication unit 206 does not change, assuring satisfactory wireless communication between the given ink cartridge 100 and the corresponding communication unit 206 in spite of the shortness of the communication range RS of the given ink cartridge 100.

Further, although the first embodiment demonstrates a cartridge only as the ink cartridge 100, the present invention is applicable to various types of cartridges, which are mounted into the main assembly of an apparatus, and the communication properties of which during shipment are desired to be different from that during actual usage. In other words, the present invention is applicable to, for example, a toner cartridge to be mounted into an electrophotographic printer, a video cassette to be mounted into a video deck, a photographic film cassette to be mounted into a camera, an FD (Flexible Disc-Cartridge) to be mounted into an FDD (FD drive), etc., in addition to an ink cartridge.

Further, the first embodiment demonstrates such a setup that the predetermined type of information is stored in the flash memory 135 of the ink cartridge 100 in the updatable fashion, and that not only is the printer main assembly 201 or the like enabled to read the predetermined type of information from the flash memory 135 of the ink cartridge, but also it is enabled to write the predetermined type of information into the flash memory 135. However, a ROM (Read Only Memory) which stores information in the non-updatable fashion may be employed as the information storage means of the ink cartridge 100, so that the printer main assembly 201 and the wireless communicating apparatus 206 are allowed only to read the predetermined type of information from the ink cartridge 100.

Further, the first embodiment demonstrates such a setup that the information storage medium of the ink cartridge 100 is a flash memory. However, it may be an EEPROM (Electrically Erasable Programmable ROM), a RAM (Random Access Memory) connected to a battery, a FeRAM (Ferro-electric RAM), a ROM, or the like.

Further, the first embodiment demonstrates such a structural arrangement that all of the various elements necessary for wireless communication are mounted on the label 120 which is a component separate from the cartridge main assembly 101. However, the circuitry chip 130 may be formed as an integral part of the cartridge main assembly 101.

Further, the first embodiment demonstrates such a structural arrangement that the ink cartridge 100 employs an electric power generating means comprising the induction coil 138 and power source circuit 137, and that electrical power is generated based on electromagnetic induction. However, the ink cartridge 100 may be provided with a battery.

Further, the first embodiment demonstrates such a case that the communicational performance of the ink cartridge 100 in terms of range can be changed by changing the length of the radio antenna 131. However, the length of the induction coil 138 may be changed in length to change the power generating performance of the induction coil 138 which affects the communication range of the ink cartridge 100.

Further, the first embodiment demonstrates such a structural arrangement that the radio antenna 131 and induction coil 138 are two separate components. However, the radio antenna 131 may be designed to also function as the induction coil 138, and vice versa. Further, this embodiment demonstrates such a case that the communicational property, in which the ink cartridge 100 being distributed is different from the same ink cartridge 100 in use, is the communication range. However, the communicational directionality may be changed.

Embodiment 2

Referring to FIGS. 13-16, an ink cartridge 160 in the second embodiment of the present invention, will be briefly described. In the following description of the ink cartridge 160, the members, component, portions, etc., thereof, which are the same as those in the first embodiment, will be given the same name and referential signs as those given to those in the first embodiment, and will not be described in detail.

[Structure]

Figure 13:
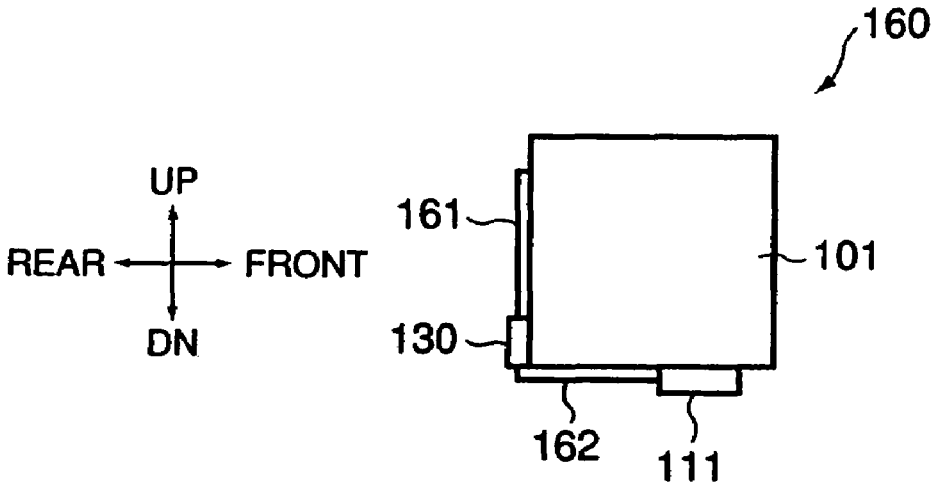
FIG. 13 is a schematic side view of the ink cartridge in the second embodiment of the present invention, during its shipment.

Referring to FIG. 13, this ink cartridge 160 in accordance with the present invention is provided with a circuitry chip 130, a first radio antenna 161, and a second radio antenna 162. The circuitry chip 130 is attached to the bottom portion of the external surface of the rear wall of the cartridge main assembly 101. The first and second radio antennas 161 and 162 are separately attached. More specifically, the first radio antenna 161 is solidly fixed to the external surface of the rear wall of the cartridge main assembly 101, whereas the second radio antenna 162 is removably attached to the external surface of the external surface of the bottom wall of the cartridge main assembly 101, in such a manner that it will be removed with the ink cap 111.

Figure 14:
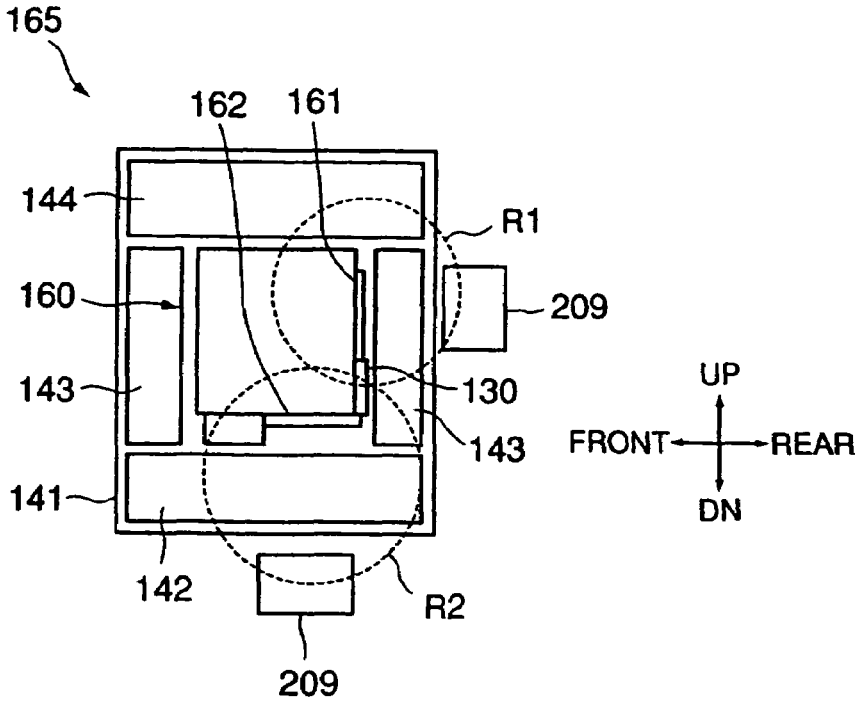
FIG. 14 is a vertical sectional view of another shipment package for an ink cartridge, at a plane parallel to one of its side walls, showing the internal structure thereof.

In the case of this ink cartridge 160, the first and second radio antennas 161 and 162 are different in the direction they extend as well as their location as described above. Therefore, the first and second communication ranges R1 and R2, that is, the communication ranges of the first and radio antennas 161 and 162, respectively, are different in directionality and location, as shown in FIG. 14. Thus, when the ink cartridge 160 is in the distribution package 165 comprising the packaging members 141-144, only the rear wall of the distribution package 165 is within the first communication range R1, and, and only the bottom wall of the distribution package 165 is within the second communication range R2.

Figure 15:
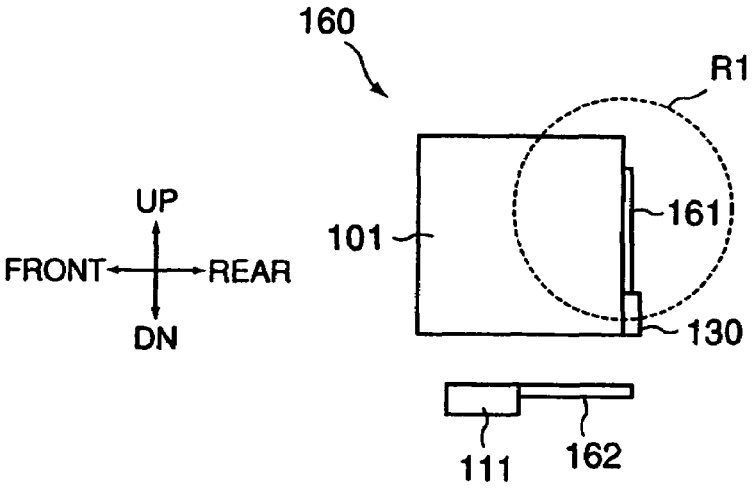
FIG. 15 is a schematic side view of the ink cartridge in use.
Figure 16:
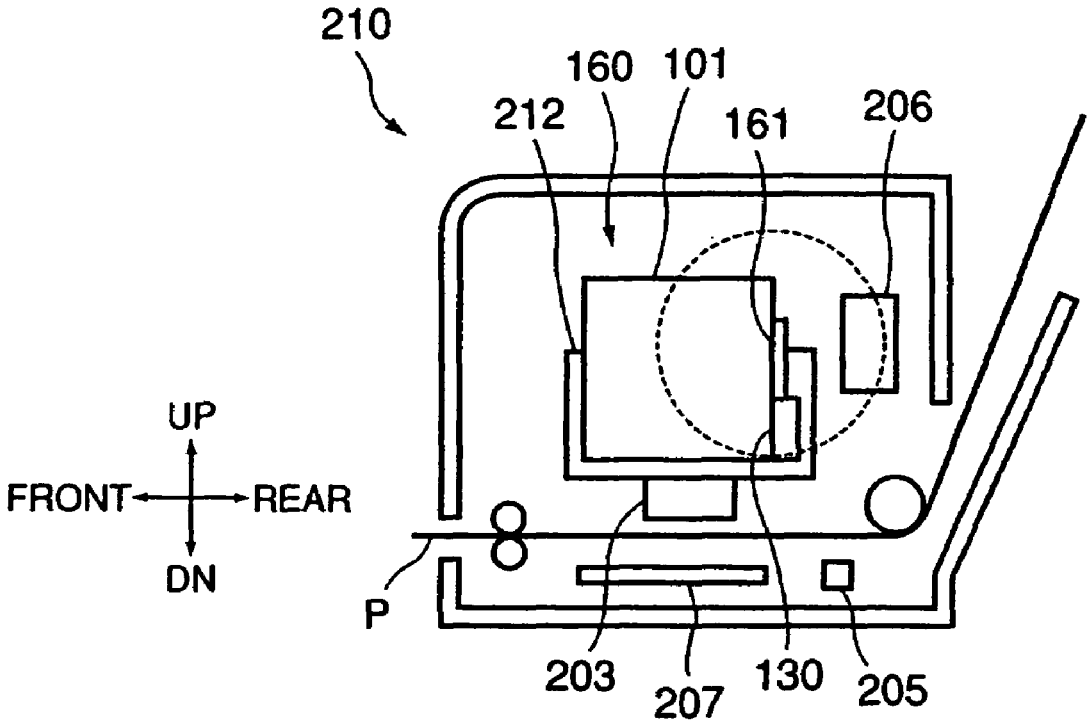
FIG. 16 is vertical sectional view of another shipment package for an ink cartridge, at a plane parallel to one of its side walls, showing the internal structure thereof.

Referring to FIG. 16, while the ink cartridge 160 is used, that is, after the proper mounting of the ink cartridge 160 into the printer main assembly 211 of a printing apparatus 210 by an end user, the second radio antenna 162 has been removed along with the ink cap 111 by the end user, as shown in FIG. 15.

Referring to FIG. 16, the printing apparatus 210 in this embodiment of the present invention is a monochromatic ink Jet printer, and its carriage 212 as a cartridge holding means holds only a single ink cartridge 160 containing ink 104 of black color.

The printing apparatus 210 is provided with a communication unit 206, a driving motor 205, a circuitry substrate 207. The communication unit 206 is disposed behind the moving range of the carriage 212 so that as the ink cartridge 160 is mounted into the carriage 212 as described above, the communication unit 206 will fall within the communication range R1 of the ink cartridge 160. The driving motor 205 and circuitry substrate 207 are disposed below the moving range of the carriage 212 so that, as the ink cartridge 160 is mounted into the carriage 212, they fall outside the communication range R1.

With the provision of the above described structural arrangement, while this ink cartridge 160 in accordance with the present invention is within a distribution system, the first radio antenna 161 having the communication range R1 is present on the rear side of the ink cartridge 160, and the second radio antenna 162 having the communication range R2 is present on the bottom side of the ink cartridge 160. However, while the ink cartridge 160 is in use, only the first radio antenna 161 having the communication range R1, that is, the radio antenna on the rear side of the ink cartridge 160, is present.

The distributor who handles this ink cartridge 160 is notified in advance that the wireless communication between the ink cartridge 100 in the distribution package 165 and the wireless communicating apparatus 209 can be established only through the back and bottom walls of the distribution package 165. Therefore, they wirelessly communicate with the ink cartridge 160 by placing the wireless communicating apparatus 206 on the rear or bottom side of the distribution package 165, as shown in FIG. 14.

Referring to FIG. 15, as an end user having obtained this ink cartridge 160 in accordance with the present invention removes the ink cap 111 from the cartridge main assembly 211, the radio antenna 162 comes off with the ink cap 111. Therefore, the communication range of the ink cartridge 160 becomes limited to the communication range R1. Thus, as this ink cartridge 160 is properly mounted into the printer main assembly 211, the communication unit 206 falls within the communication range R1, being enabled to wirelessly communicate with the ink cartridge 160.

[Effects]

In the case of the ink cartridge 160 in this embodiment of the present invention, the first and second communication ranges R1 and R2 are on the rear and bottom sides, respectively, of the distribution package 165, making it possible for the wireless communicating apparatus 209 to satisfactorily communicate with the ink cartridge 160 in the distribution package 165, from both the rear and bottom sides. Therefore, the ink cartridge 160 is more convenient in usage compared to the ink cartridge 100 in the first embodiment of the present invention, the communication with which can be established only from one side.

Moreover, a person who does not know that the ink cartridge 160 is enabled to wirelessly communicate from both the rear side, where the communication range of the ink cartridge 160 is R1, and the bottom side, where the communication range of the ink cartridge 160 is R2, fails to establish data communication between the wireless communicating apparatus 206 and the ink cartridge 160, even if the person has the wireless communicating apparatus 206. In other words, this embodiment is desirable in terms of security.

Further, while the ink cartridge 160 in the second embodiment of the present invention is used, the range in which wireless communication can be established between the ink cartridge 160 and the printer main assembly 211 is only the first communication range R1, which is on the rear side of the ink cartridge 160. Therefore, satisfactory wireless communication can be established between the ink cartridge 160 and the communication unit 206 located in the rear portion of the printer main assembly 211, without adversely affecting the circuitry substrate 207 and microcomputer in the bottom portion of the printer main assembly 211.

[Modifications]

The ink cartridge 160 in the second embodiment of the present invention, demonstrates such a structural arrangement that for the sake of flexibility in communicational directionality, an ink cartridge is provided with two radio antennas 161 and 162 different in location and extensional direction, and that one (162) of the radio antennas is made removable. However, an ink cartridge may be provided with a single L-shaped radio antenna (unshown), one of the two straight portions of which perpendicular to each other can be removed to restrict the communicational directionality of the ink container.

The ink cartridges 100 and 160 in the first and second embodiments of the present invention, respectively, demonstrate such arrangements that the communication properties of an ink cartridge in use are different from the communication properties of the same ink cartridge during shipment. However, an ink cartridge may be designed so that its communication properties after it is removed from the printer main assembly 201 or 211 are different from both of its communication properties while it is shipped and its communication properties while it is used.

Embodiment 3

Figure 17:
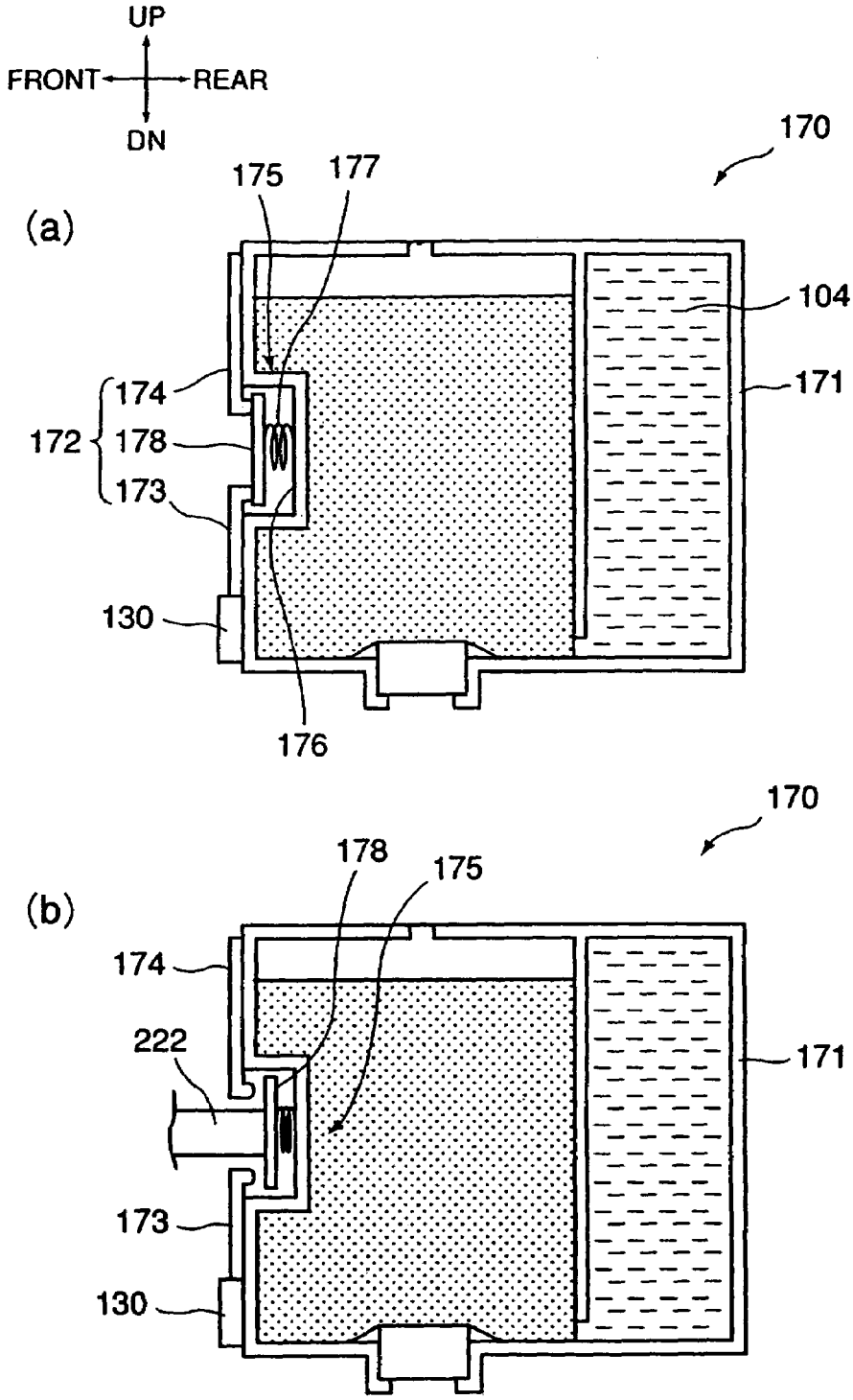
FIGS. 17(*a*)-17(*b*) is a vertical sectional view of the ink cartridge in the third embodiment of the present invention, at a plane parallel to one of its side walls, showing the internal structure thereof.
Figure 18:
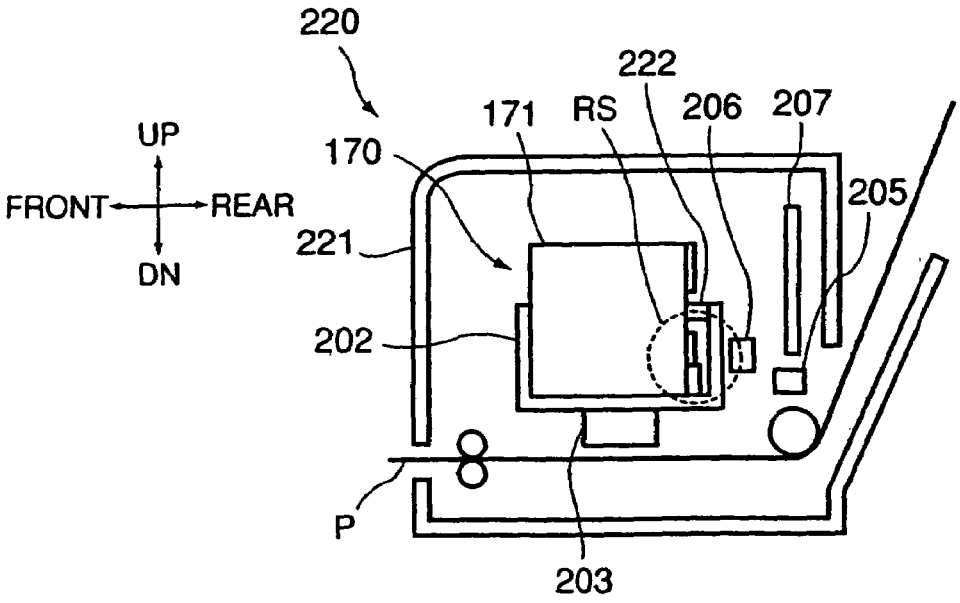
FIG. 18 is a vertical sectional view of another shipment package for an ink cartridge, at a plane parallel to one of its side walls, showing the internal structure thereof.
Figure 19:
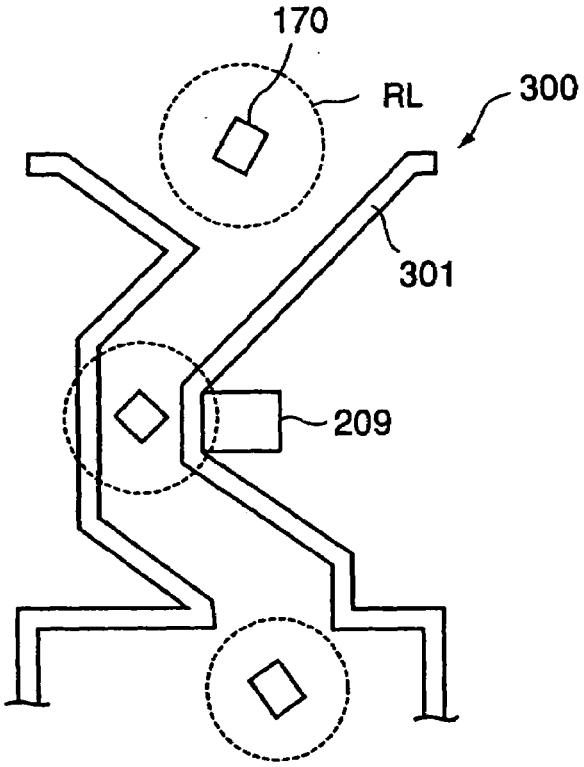
FIG. 19 is a schematic drawing for showing the internal structure of the cartridge collecting apparatus.

Referring to FIGS. 17-19, an ink cartridge 170, in the third embodiment of the present invention, the communication properties of which after it is discarded are different from those while it is shipped and those while it is in use, will be briefly described next.

Referring to FIG. 17, the ink cartridge 170 in the third embodiment of the present invention is provided with a circuitry chip 130 and a radio antenna 172. The circuitry chip 130 is on the bottom end of the external surface of the front wall of the cartridge main assembly 171, and the radio antenna 172 is on the portion of the external surface of the front wall of the cartridge main assembly 171 above the circuitry chip 130.

More specifically, the radio antenna 172 has three distinctive portions: a first portion 173, or the top portion, a second portion 174, or the bottom portion, and a third portion 178, or the middle portion. The first and second portions 173 and 174 are electrically connected or disconnected by the third portion 178, which constitutes a part of a pressure switch 175 of a contact type as the means for switching the antenna properties. To describe more concretely, the front wall of the cartridge main structure 171 has a recess 176, in which the contact type pressure switch 175, that is, the combination of the third portion 178 of the radio antenna 172, and a compression spring 177 as a pressure generating means, is disposed.

Referring to FIG. 17(*b*) and FIG. 18, as this ink cartridge 170 is mounted into the main assembly 221 of the printing apparatus 220, the contact type pressure switch 175 is turned off by a projection 222 protruding frontward from the rear portion of the carriage 202. In other words, the contact type pressure switch 175 is off only after the proper mounting of the ink cartridge 170 into the apparatus main assembly 221, that is, while the ink cartridge 170 is in use.

With the provision of the above described structural arrangement, while the ink cartridge 170 is within a distribution system, the contact type pressure switch 175 is on, providing the ink cartridge 170 with a communication range RL of a predetermined size, whereas after the proper mounting of the ink cartridge 170 into the apparatus main assembly 221, that is, while the ink cartridge 170 is in use, the contact type pressure switch 175 remains turned off by the projection 222 protruding frontward from the rear portion of the carriage 202, providing the ink cartridge 170 with a communication range RS, which is shorter than the communication range RL with which the ink cartridge 170 is provided while it is within the distribution system.

In addition, in the case of this ink cartridge 170, as it is removed from the printer main assembly 221 to be discarded, the contact type pressure switch 175 is again turned on, providing the ink cartridge 170 with the communication range RL which is longer than the communication range RS with which the ink cartridge 170 is provided while it is in use. After removal, the ink cartridge 170 is to be discarded into an apparatus 300 dedicated to cartridge collection. Referring to FIG. 19, as the ink cartridge 170 is tossed into the main assembly 301 of the cartridge collecting apparatus 300, the wireless communicating apparatus 209 of the cartridge collecting apparatus 300 wirelessly communicates with the ink cartridge 170.

Also referring to FIG. 19, the neck portion of the main assembly 301 of this cartridge collecting apparatus 300 in this embodiment of the present invention, through which the discarded ink cartridge 170 enters the apparatus main assembly 301, is bent at a predetermined angle and is made narrower than the communication range RL of the ink cartridge 170, that is, the communication range of ink cartridge 170 after the discarding of the ink cartridge 170. The wireless communicating apparatus 209 is disposed at the bend of the neck portion.

[Effects]

In the case of the ink cartridge 170 in the third embodiment of the present invention, the communication range RS, which is the communication range of the ink cartridge 170 during its usage, is shorter than the communication range RL, which is the communication range of the ink cartridge 170 during its shipment, but, as the ink cartridge 170 is removed from the printer main assembly 221 to be discarded, the communication range of the ink cartridge 170 reverts to the communication range RL, which is longer than the communication range RS. Therefore, as the ink cartridge 170 is tossed into the cartridge collecting apparatus 300 after its removal from the printer main assembly 221, wireless communication is satisfactorily established between the ink cartridge 170 and the wireless communicating apparatus 209 of the cartridge collecting apparatus 300, making it easier for a waste disposal dealer to manage the data regarding the ink cartridge 170.

In addition, as the ink cartridge 170 is mounted into the printer main assembly 221, the contact type pressure switch 175 is automatically turned off, reducing the communication range of the ink cartridge 170 to the communication range RS, that is, the shorter one of the two communication ranges of the ink cartridge 170, whereas as the ink cartridge 170 is removed from the printer main assembly 221, the contact type pressure switch 175 is automatically turned on, increasing the communication range of the ink cartridge 170 to the communication range RL, that is, the longer one. Therefore, an end user is not required to carry out an operation dedicated to the switching of the communication range of the ink cartridge 170.

Further, in the case of the cartridge collecting apparatus 300 in the third embodiment of the present invention, its communicating apparatus 209 is disposed so that as the ink cartridge 170 is tossed into the main assembly 301 of the cartridge collecting apparatus 300 and falls through the neck portion of the main assembly 301, the communicating apparatus 209 falls within the communication range RL of the ink cartridge 170. Therefore, the wireless communicating apparatus 209 is allowed to wirelessly communicate with only the single ink cartridge 170, which is falling through the neck portion.

[Modifications]

Figure 20:
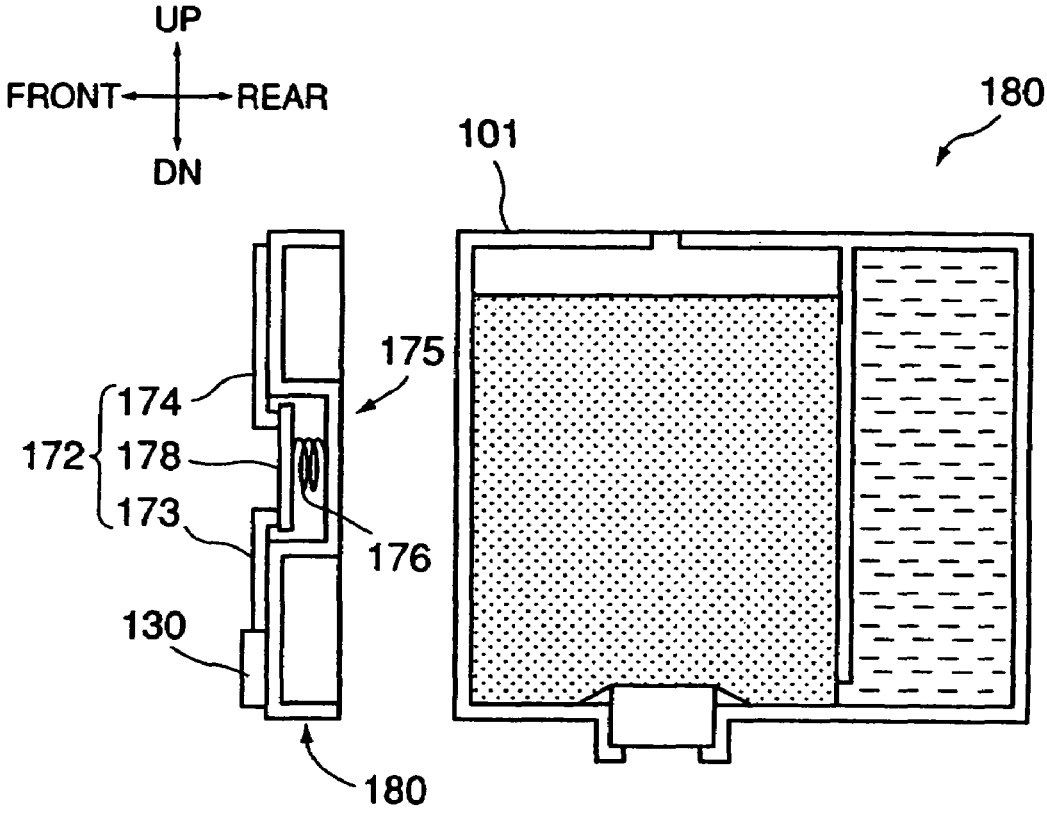
FIG. 20 is a vertical sectional view of the ink cartridge in the modification of third embodiment of the present invention, at a plane parallel to one of its side walls, showing the internal structure thereof.

The ink cartridge 170 in the third embodiment of the present invention demonstrates such a structural arrangement that the contact type pressure switch 175, circuitry chip 130, radio antenna 172, etc., are all integral parts of the cartridge main assembly 171. However, each of the above listed components may be mounted on a communication unit 181, which is discrete from the cartridge main assembly 101, as those of an ink cartridge 180 shown in FIG. 20.

Further, the ink cartridge 170 demonstrates such a structural arrangement that as the ink cartridge 170 is mounted into the carriage 202, the contact type pressure switch 175 is turned off by the projection 222 of the carriage 202. However, the contact type pressure switch 175 may be turned off or on by a projection 222 slidable with the use of a solenoid (unshown).

Further, the cartridge collecting apparatus 300 in the third embodiment of the present invention, is an example of a cartridge collecting apparatus (300), the main assembly of which is shaped so that the wireless communicating apparatus (209) of the cartridge collecting apparatus (300) is allowed to communicate, only one at a time, with the plurality of ink cartridges (170) tossed into the cartridge collecting apparatus (300). However, the design of the cartridge collecting apparatus 300 may be modified so that the wireless communicating apparatus 209 is allowed to communicate, all at once, with all of the plurality of ink cartridges 170 tossed into the cartridge collecting apparatus 300, as long as each of the plurality of ink cartridges 170 is enabled to wirelessly transmit, for example, an identification data capable of preventing the interference among the radio waves from the plurality of ink cartridges 170.

Further, this embodiment demonstrates only such a business model that the ink cartridge data are managed by a waste disposal dealer. However, such a business model is also feasible that ink cartridge data are managed solely by an ink cartridge manufacturer from the beginning of the ink cartridge manufacture to the end of the ink cartridge disposal.

For example, the identification data of each ink cartridge 170 are stored by the manufacturer. Then, the internet can be used to trace each ink cartridge 170 and collect the various post-manufacture information of each ink cartridge 170, through the wireless communicating apparatus 206 of each distributor having a contract with the manufacturer, the personal computer of an end user connected to the registered printing apparatus 220, the wireless communicating apparatus 220 of each waste disposal dealer having a contract with the manufacturer (unshown).

In this case, the ink cartridge manufacturer can trace each ink cartridge 170 from the beginning of its manufacture until the end of its disposal, being enabled to use the data obtained by tracing each ink cartridge 170, for making or modifying production plans.

Embodiment 4

Figure 21:
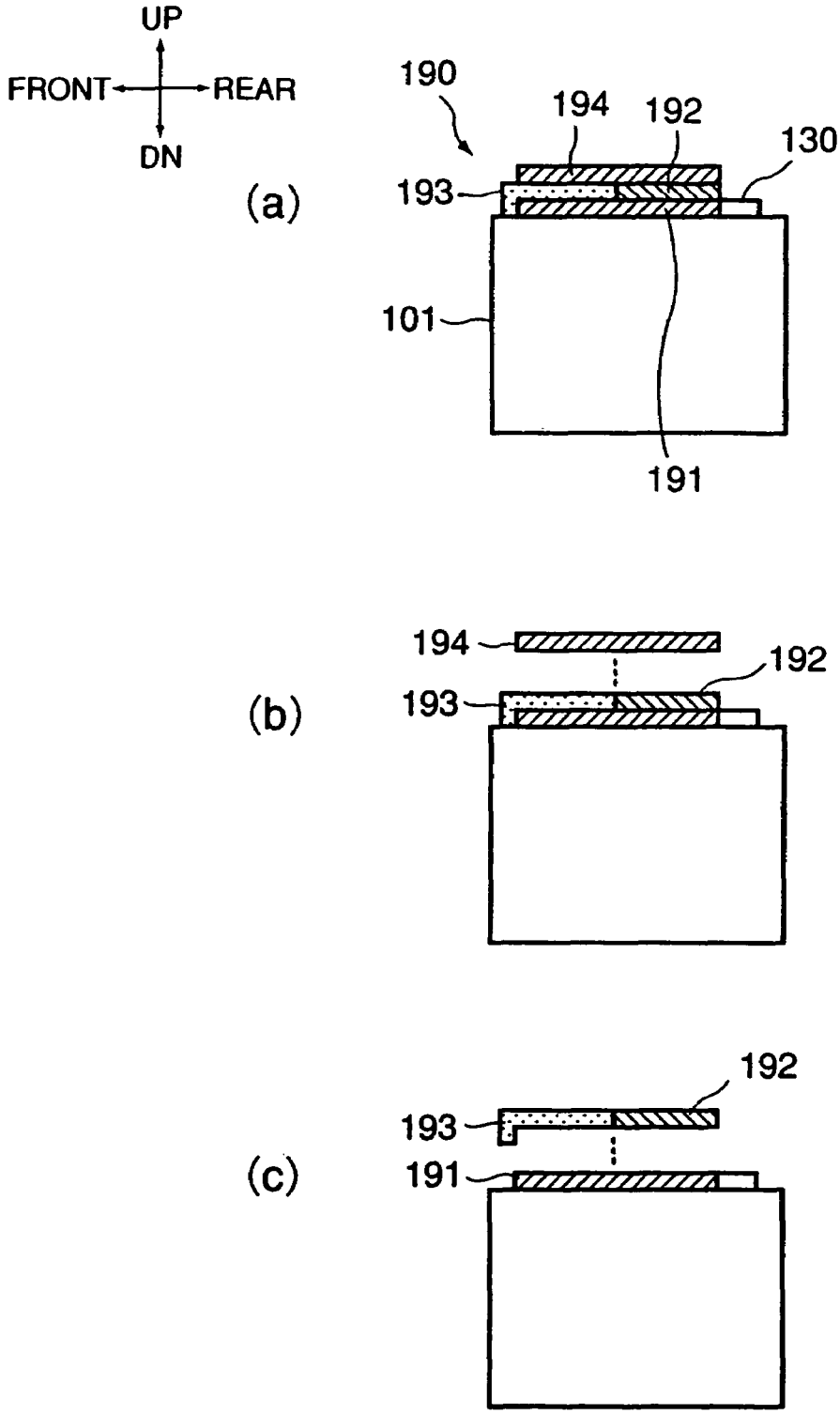
FIGS. 21(*a*)-21(*c*) is a schematic side view of the fourth embodiment of an ink cartridge in accordance with the present invention.

Next, referring to FIG. 21, the fourth embodiment of the present invention will be briefly described.

[Structure]

An ink cartridge 190 in the fourth embodiment of the present invention has a circuitry chip 130, which is on the rear portion of the external surface of the top wall of the cartridge main assembly 101. The ink cartridge 190 also has a first radio antenna is 191 having a predetermined length, which is on the front side of the external surface of the top wall of the cartridge main assembly 101.

Further, the ink cartridge 190 has a second radio antenna 192, a radio wave absorption layer 193, and a third radio antenna 194. The second radio antenna 192 is shorter than the first radio antenna 191, and is layered across the rear half of the top surface of the first radio antenna 191. The radio wave absorption layer 192 is a communication blocking means, and is layered across the front half of the top surface of the first radio antenna 191. The third radio antenna 194 has the same length as the first radio antenna 191, and is layered across both the top surface of the second radio antenna 192 and the surface of the radio wave absorption layer 193.

The third radio antenna 194 is an integral part of the label (unshown), and is removably attached to the top surface of the second radio antenna 192 and the top surface of the radio wave absorption layer 193, as shown in FIG. 21(*b*). The second radio antenna 192 and radio wave absorption layer 193 together are in the form of a coupon (unshown), and is removably attached to the top surface of the first radio antenna 191, as shown in FIG. 21(*c*).

The radio wave absorption layer 193 is formed of a substance such as ferrite or carbon which absorbs radio waves. Thus, while the ink cartridge 190 is used, that is, after the removal of the third radio antenna 194, the radio wave absorption layer 193 prevents the portion of the first radio antenna 191 under the radio absorption layer 193, from functioning.

In the case of the ink cartridge 190 structured as described above, while the ink cartridge 190 is distributed, the third radio antenna 194 remains on the ink cartridge 190, as shown in FIG. 21(*a*), and therefore, the communication range of the ink cartridge 190 is a communication range RL of a predetermined size, whereas while the ink cartridge 190 is in use, that is, after the proper mounting of the ink cartridge 190 into the printer main assembly 201, the third radio antenna 194 has been removed, only the second radio antenna 192 functioning, as shown in FIG. 21(*b*), and therefore, the communication range of the ink cartridge 190 is a communication range RS, which is shorter than the communication range RL, or the communication range of the ink cartridge 190 while it is distributed.

After the removal of the ink cartridge 190 from the printer main assembly 201, more specifically, when the ink cartridge 190 is ready to be discarded, the second radio antenna 192 is removed along with the radio wave absorption layer 193 by, for example, a waste disposal dealer, as shown in FIG. 21(*c*), allowing the first radio antenna 191 to fully function. Therefore, the communication range of the ink cartridge 190 is again RL, which is longer than RS, that is, the communication range of the ink cartridge 190 during its use.

Further, in the case of the ink cartridge 190, the second radio antenna 192 and radio wave absorption layer 193 together are in the form of a coupon. Therefore, as an end user hands a used ink cartridge 190 to, for example, a waste disposal dealer, the waste disposal dealer is to pay a recycling fee to the end user, and the waste disposal dealer is to collect a recycling fee from a manufacturer in exchange for the coupon.

[Effects]

Also in the case of this ink cartridge 190 in fourth embodiment of the present invention, while the ink cartridge 190 is in use, its communication range is the communication range RS, which is shorter than the communication range RL, that is, the communication range of the ink cartridge 190 while it is distributed, but, after the discarding of the ink cartridge 190, the communication range of the ink cartridge 190, is again the communication range RL, which is longer than the communication range RS, or the communication range of the ink cartridge 190 while it is in use.

Further, the second radio antenna 192 and radio wave absorption layer 193 together are in the form of, for example, a coupon. Therefore, it is possible to urge an end user to recycle the used ink cartridge 190 by setting up such a system that a waste disposal dealer is to pay an end user a recycling fee in exchange for the coupon, and the waste disposal dealer is to collect a recycling fee from a manufacturer in exchange for the coupon.

[Modifications]

Figure 22:
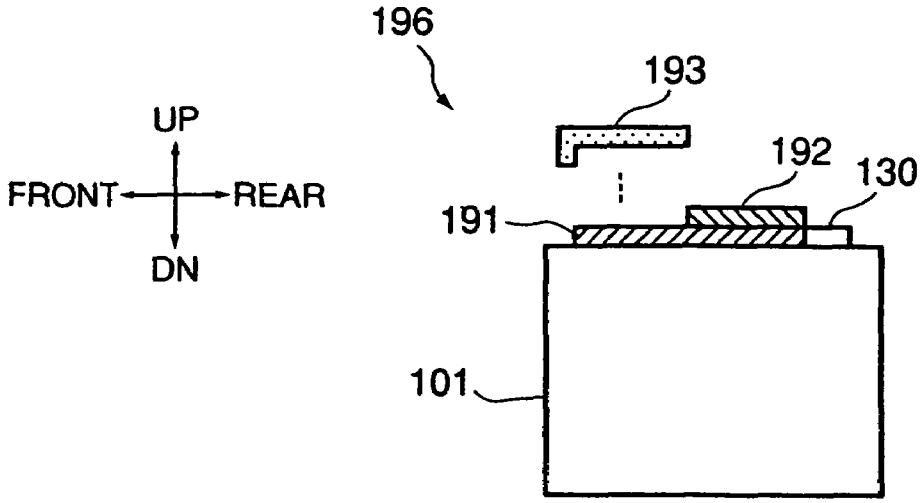
FIG. 22 is a schematic side view of the ink cartridge ink in a modification of the fourth embodiment of the present invention, at a plane parallel to one of its side walls.
Figure 23:
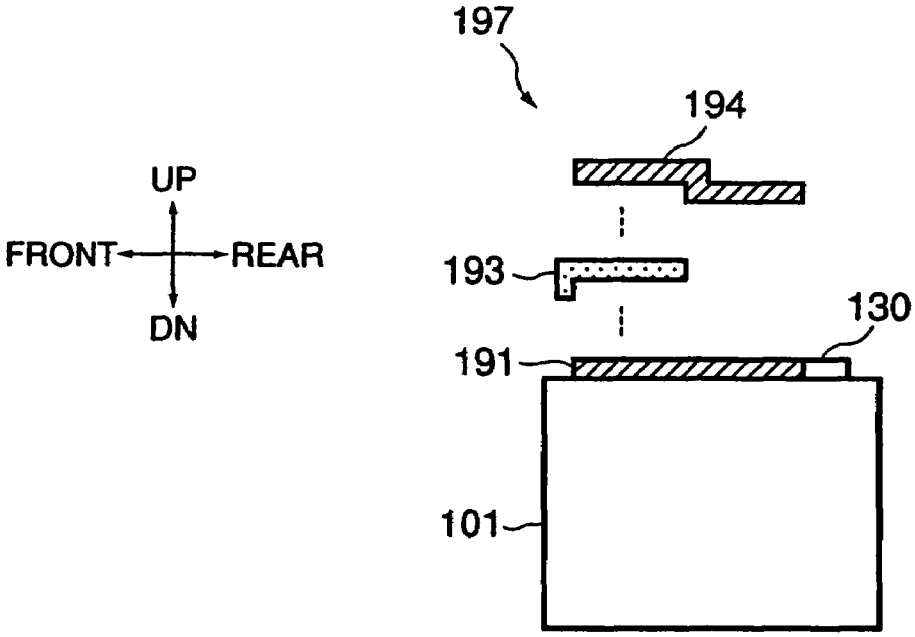
FIG. 23 is a schematic side view of the ink cartridge in another modification of the fourth embodiment of the present invention, at a plane parallel to one of its side walls.

The ink cartridge 190 in the fourth embodiment of the present invention, demonstrates such a structural arrangement that the radio wave absorption layer 193 is removed along with the radio antenna 192. However, only the radio wave absorption layer 193 may be removed, leaving the second radio antenna 192 on the Ink cartridge 190, as in the case of an ink cartridge 196 shown in FIG. 22. Also, the second radio antenna 192 may be eliminated as in the case of an ink cartridge 197 shown in FIG. 23.

An ink cartridge in accordance with the present invention is capable of wirelessly transmitting the predetermined type of information from its information storage means, through a radio antenna, the communication properties of which are controllable. Therefore, the communication properties of the ink cartridge can be optimized in accordance with the situation in which the ink cartridge is placed, for example, while the ink cartridge is distributed, while the ink cartridge is used, after it is discarded, etc.

The present invention is conveniently applicable to a process cartridge for an electrophotographic image forming apparatus, which is detachably mountable to the apparatus, such as the ones disclosed in U.S. Pat. Nos. 6,404,995 or 5,923,917, or Japanese Laid-open Patent Application No. 2000-330434, for example, in place of the recording liquid container described in the foregoing. The process cartridge may contain as a unit an electrophotographic photosensitive member and charge means, developing means or cleaning means (process means), the unit being detachably mountable to the main assembly of the electrophotographic image forming apparatus. The process cartridge may contain as a unit an electrophotographic photosensitive member and at least one of charge means, developing means and cleaning means (process means), the unit being detachably mountable to the main assembly of the electrophotographic image forming apparatus. The process cartridge may contain as a unit an electrophotographic photosensitive member and at least developing means (process means), the unit being detachably mountable to the main assembly of the electrophotographic image forming apparatus.

The present invention is also conveniently applicable to a developer container for an electrophotographic image forming apparatus, which is detachably mountable to the apparatus or to a developing device, such as the ones disclosed in U.S. Pat. Nos. 5,649,270 or 5,351,728 or Japanese Laid-open Patent Application No. 2000-330434, for example, in place of the recording liquid container described in the foregoing.

The present invention is also conveniently applicable to a developing device for an electrophotographic image forming apparatus, which is detachably mountable to the apparatus, such as the ones disclosed In U.S. Pat. No. 5,956,541, for example, in place of the recording liquid container described in the foregoing.

In these applications to the electrophotographic apparatuses and components, the memory elements and antenna elements described in the foregoing embodiments replace the memory elements and the antenna elements of the electrophotographic apparatuses and components. The memory elements may store all or a piece or pieces of information disclosed in the above-mentioned publications as well as the above-described distribution, shipment or transportation controls.

While the invention has been described with reference to the structures disclosed herein, it is not confined to the details set forth, and this application is intended to cover such modifications or changes as may come within the purposes of the improvements or the scope of the following claims.

What is claimed is:

1. A recording liquid container for containing liquid for recording to be supplied to recording means, said recording liquid container being detachably mountable to a mounting portion of a recording device, said recording liquid container comprising:

an information memory medium storing predetermined information;

wireless sending means capable of wireless sending of a predetermined information in said information memory medium within a predetermined range;

a wireless communication antenna for wirelessly sending radio wave; and a communication property changing means for changing a communication property of the wireless sending, wherein said wireless communication antenna has antenna members having directivities different from that of each other, and said communication property changing means selectively validates directivities, and wherein said communication property changing means validates a plurality of directivities of said wireless sending during a transportation stage before said recording liquid container is mounted to said recording device, and validates a single directivity of said wireless sending when said recording liquid container is mounted to said recording device.

2. A container according to claim 1, wherein said communication property is a sendable range of the wireless sending.

3. A container according to claim 1, wherein said communication property changing means has a projecting member which is detachably mounted to said recording liquid container, and wherein said antenna has a first portion which is fixed to said recording liquid container and a second portion fixed to said protecting member.

4. A container according to claim 1, wherein said communication property changing means connect or disconnect a first portion and a second portion of said antenna.

5. A container according to claim 4, wherein said antenna has a third portion which is movable to and away from said first and second portions, and wherein said communication property changing means has resilient means for resiliently urging said third portion toward a position where said third portion is contacted to said fast portion and said second portion.

6. A container according to claim 1, wherein said wireless communication antenna has antenna members having lengths different from each other, and said communication property changing means selectively validates said antenna members.

7. A container according to claim 6, wherein said antenna members are sheet-like antennas and are removably laminated with sheet-like communication preventing means.

8. A container according to claim 1, wherein said communication property changing means makes the sendable range of said wireless sending smaller when said cartridge is mounted to said recording device than when said cartridge is removed from said recording device and is disposable.

9. A container according to claim 1, wherein said recording device includes electric power supplying means for supplying electric power through electromagnetic induction, and said recording liquid container has electric power generating means for generating electric power by said electromagnetic induction and supplying the electric power to said wireless sending means.

10. A container according to claim 1, wherein said information memory medium renewably stores the predetermined information and has information accommodating means, said container further comprising wireless reception means, wherein said wireless reception means wirelessly receives radio wave and converts the radio wave to information, which is accommodated in said information accommodating means.

11. A container according to claim 1, wherein said recording liquid container is accommodated in a package having a portion through which the wireless communication is capable, during transportation.

12. A container according to claim 1, wherein said recording liquid container is accommodated in a package having a portion through which the wireless communication is capable in a plurality of directions, during transportation.

* * * * *

UNITED STATES PATENT AND TRADEMARK OFFICE

CERTIFICATE OF CORRECTION

PATENT NO. : 7,252,376 B2
APPLICATION NO. : 11/147165
DATED : August 7, 2007
INVENTOR(S) : Nobuyuki Hatasa et al.

It is certified that error appears in the above-identified patent and that said Letters Patent is hereby corrected as shown below:

COLUMN 8
Line 3, “a” should read --are--.

COLUMN 12
Line 21, “of the external surface” should be deleted; and
Line 20, “radio” should read --second radio--.

COLUMN 14
Line 1, “which” should read --which is--.

COLUMN 16
Line 61, “is” should be deleted.

COLUMN 19
Line 42, “projecting” should read --protecting--.

COLUMN 20
Line 6, “fast” should read --first--;
Line 19, “cartridge” should read --container--; and
Line 20, “cartridge” should read --container--.

Signed and Sealed this

Twelfth Day of August, 2008

JON W. DUDAS
*Director of the United States Patent and Trademark Office*